US005809459A

United States Patent [19]

Bergstrom et al.

[11] Patent Number: 5,809,459

[45] Date of Patent: Sep. 15, 1998

[54] METHOD AND APPARATUS FOR SPEECH EXCITATION WAVEFORM CODING USING MULTIPLE ERROR WAVEFORMS

[75] Inventors: Chad Scott Bergstrom, Chandler; Carl Steven Gifford, Gilbert; Richard James Pattison, Mesa; Glen Patrick Abousleman, Scottsdale, all of Ariz.

[73] Assignee: Motorola, Inc., Schaumburg, Ill.

[21] Appl. No.: 651,172

[22] Filed: May 21, 1996

[51] Int. Cl.[6] ..... G10L 9/00; G10L 9/14

[52] U.S. Cl. ..... 704/223; 704/218; 704/219; 704/220; 704/264

[58] Field of Search ..... 395/2.23, 2.27, 395/2.28, 2.29, 2.31, 2.32, 2.33, 2.39; 704/214, 218, 219, 220, 222, 223, 224, 230, 262, 264

[56] References Cited

U.S. PATENT DOCUMENTS

| | | | |
|---|---|---|---|
| 5,479,559 | 12/1995 | Fette et al. | 704/207 |
| 5,504,834 | 4/1996 | Fette et al. | 704/207 |
| 5,579,437 | 11/1996 | Fette et al. | 704/262 |
| 5,596,676 | 1/1997 | Swaminathan et al. | 704/208 |
| 5,602,959 | 2/1997 | Bergstrom et al. | 704/205 |
| 5,623,575 | 4/1997 | Fette et al. | 704/265 |

FOREIGN PATENT DOCUMENTS

| | | | |
|---|---|---|---|
| 5-265496 | 10/1993 | Japan | G10L 9/14 |
| 5-265499 | 10/1993 | Japan | G10L 9/18 |
| 6-222797 | 8/1994 | Japan | G10L 9/14 |

OTHER PUBLICATIONS

An article entitled "Transformation and Decomposition of the Speech Signal For Coding", by W. Kleign and J. Haagen from IEEE Signal Processing Letters, vol. 1, No. 9, Sep. 1994.

Allen Gersho, "Advances in Speech and Audio Compression," Proc. IEEE, pp. 900–918, Jun. 1994.

Andreas S. Spanias, "Speech Coding: A Tutorial Review," Proc. IEEE, pp. 1541–1582, Oct. 1994.

Peter Noll, "Digital Audio Coding for Visual Communications," IEEE, pp. 925–943, Jun. 1995.

An article entitled "Statistical Theory Of Communication" by Y. W. Lee, John Wiley & Sons, Inc., Second Printing, Dec. 1961, (60–10318).

An article entitled "Probability, Random Variables, And Random Signal Principles" by Peyton Z. Peebles, Jr., Ph.D., McGraw–Hill Book Company, Second Edition, Copyright 1987, 1980, (ISBN 0–07–049210–0).

An article entitled "Numerical Recipes In C" by William H. Press et al., Cambridge University Press, copyright 1988, (87–33844).

*Primary Examiner*—David R. Hudspeth
*Assistant Examiner*—Tālivaldis Ivars Šmits
*Attorney, Agent, or Firm*—Sherry J. Whitney

[57] ABSTRACT

A method and apparatus (100) for pitch-epoch-synchronous source-filter speech encoding by means of error component modeling methods (310) which capture fundamental orthogonal (uncorrelated) basis elements of an excitation source waveform. A periodic waveform model (318) along with four orthogonal error waveforms, desirably including phase error (319), ensemble error (321), standard deviation error (323), and mean error (324) waveforms, are incorporated together to form a complete description of the excitation. These error waveforms (319,321, 323, 324) represent those portions of the excitation that are not represented by the purely periodic model. By thus orthogonalizing the error components, the perceptual effect of each element is isolated from the composite set, and can thus be encoded separately. In addition to high-quality, fixed-rate operation, the identity-system capability and low complexity of the speech encoding method and apparatus make them applicable to variable-rate applications without changing underlying modeling methods.

64 Claims, 22 Drawing Sheets

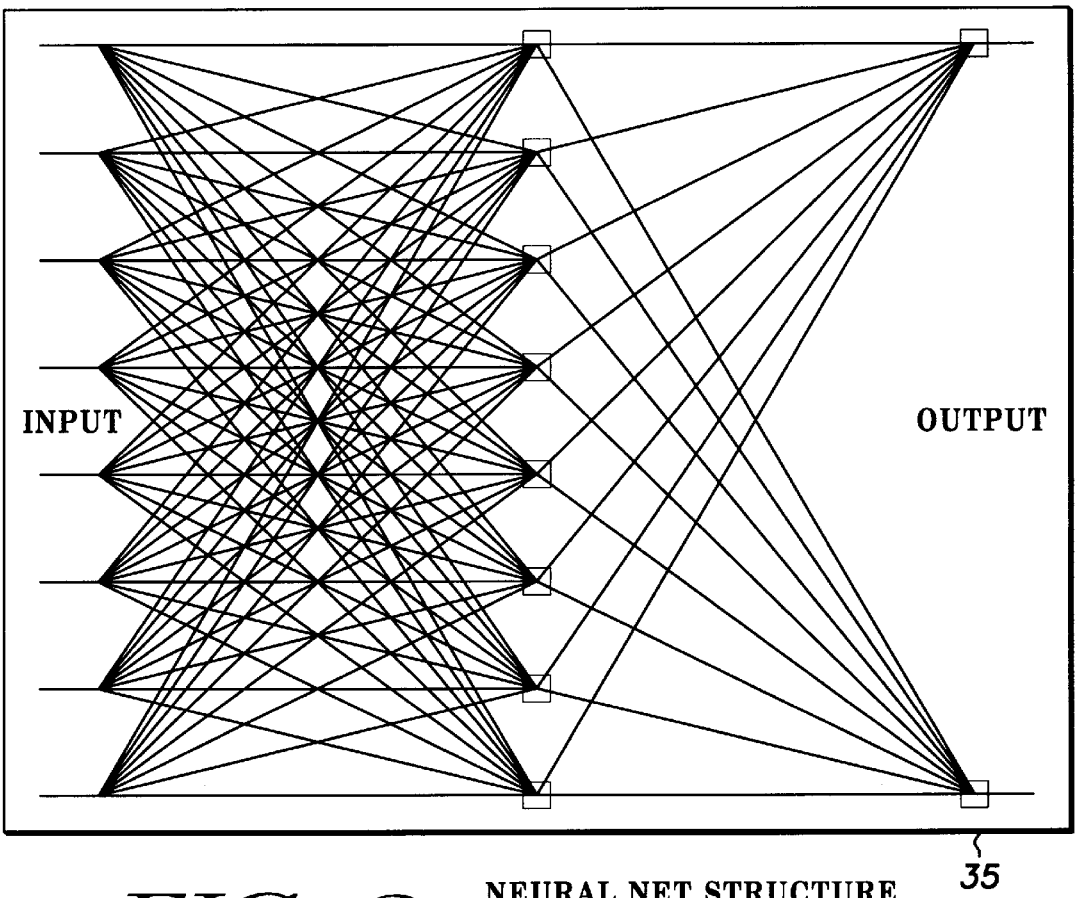
FIG. 2 NEURAL NET STRUCTURE
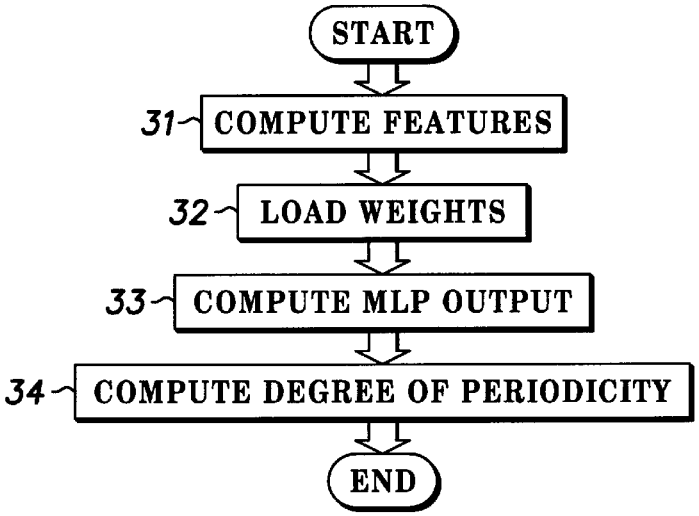
FIG. 3

METHOD AND APPARATUS FOR SPEECH EXCITATION WAVEFORM CODING USING MULTIPLE ERROR WAVEFORMS

FIELD OF THE INVENTION

The present invention relates generally to speech compression, and more specifically to speech compression using multiple error components derived from the excitation waveform.

BACKGROUND OF THE INVENTION

Prior-art speech compression techniques use modeling methods that cannot converge to original speech quality regardless of bandwidth or processing effort. Such prior-art methods rely heavily on classification and over-simplified modeling methodologies, resulting in poor performance and low speech quality.

Over-simplified modeling techniques can introduce significant error in fundamental speech and excitation parameters, causing audible distortion in the synthesized speech waveform. Such algorithms can also fail to function properly in the face of classification errors, especially in the presence of interference. Furthermore, prior-art, speech coding algorithms often implement fragile, non-robust parameter extraction techniques. These prior-art speech compression methods are typically inflexible, making it difficult to adapt them to multiple data rates.

What are needed are class-insensitive speech compression methods which encode a fundamental model and multiple orthogonal components which represent errors introduced by the fundamental model. What are further needed are robust parameter extraction techniques and flexible modeling methodologies which provide for operation at multiple data rates.

BRIEF DESCRIPTION OF THE DRAWINGS

FIG. 2 illustrates a multi-layer perceptron classifier structure in accordance with a preferred embodiment of the present invention;

FIG. 3 illustrates a method for calculating the degree of periodicity in accordance with a preferred embodiment of the present invention;

DETAILED DESCRIPTION OF THE DRAWING

The method and apparatus of the present invention provides class-insensitive speech compression methods which encode a fundamental model and multiple orthogonal components which represent errors introduced by the fundamental model. The method and apparatus of the present invention further provides robust parameter extraction techniques and flexible modeling methodologies which enable operation at multiple data rates.

As will be described in detail below, the method and apparatus of the present invention provides improvement over prior art methods via convergence to an identity system (i.e., a system where output speech sounds identical to input speech) given sufficient bandwidth, reduced reliance on classification, reduced sensitivity to interference, robust parameter extraction techniques, and simple adaptation to multiple data rates.

Prior-art, class-based interpolative speech coding methods cannot converge to perfect speech due to the simplicity of underlying models. Such simple models are unable to capture the underlying components of the excitation. These simplistic models are subject to a quality plateau, where perceptual speech quality fails to improve regardless of bandwidth or processing effort.

The method and apparatus of the present invention achieves transparent speech output given sufficient bandwidth by means of new and novel error component modeling methods which orthogonalize and capture the fundamental basis elements of the excitation waveform. A periodic waveform model is incorporated along with four orthogonal error waveforms which together form a complete description of the excitation. These error waveforms represent those portions of the excitation which are not represented by the purely periodic model. By orthogonalizing the error components, the perceptual effect of each element is isolated from the composite set, and can thus be encoded separately.

In addition to high-quality, fixed-rate operation, the identity-system capability and low complexity of this invention make it ideal for use in variable-rate applications. Such applications can be easily derived from the baseline algorithm without changing underlying modeling methods. As will be described in detail below, the method and apparatus of the present invention provide improvements over prior art methods via convergence to an identity system given sufficient bandwidth, reduced reliance on classification, reduced sensitivity to interference, robust parameter extraction techniques, and simple adaptation to multiple data rates.

Figure 1:
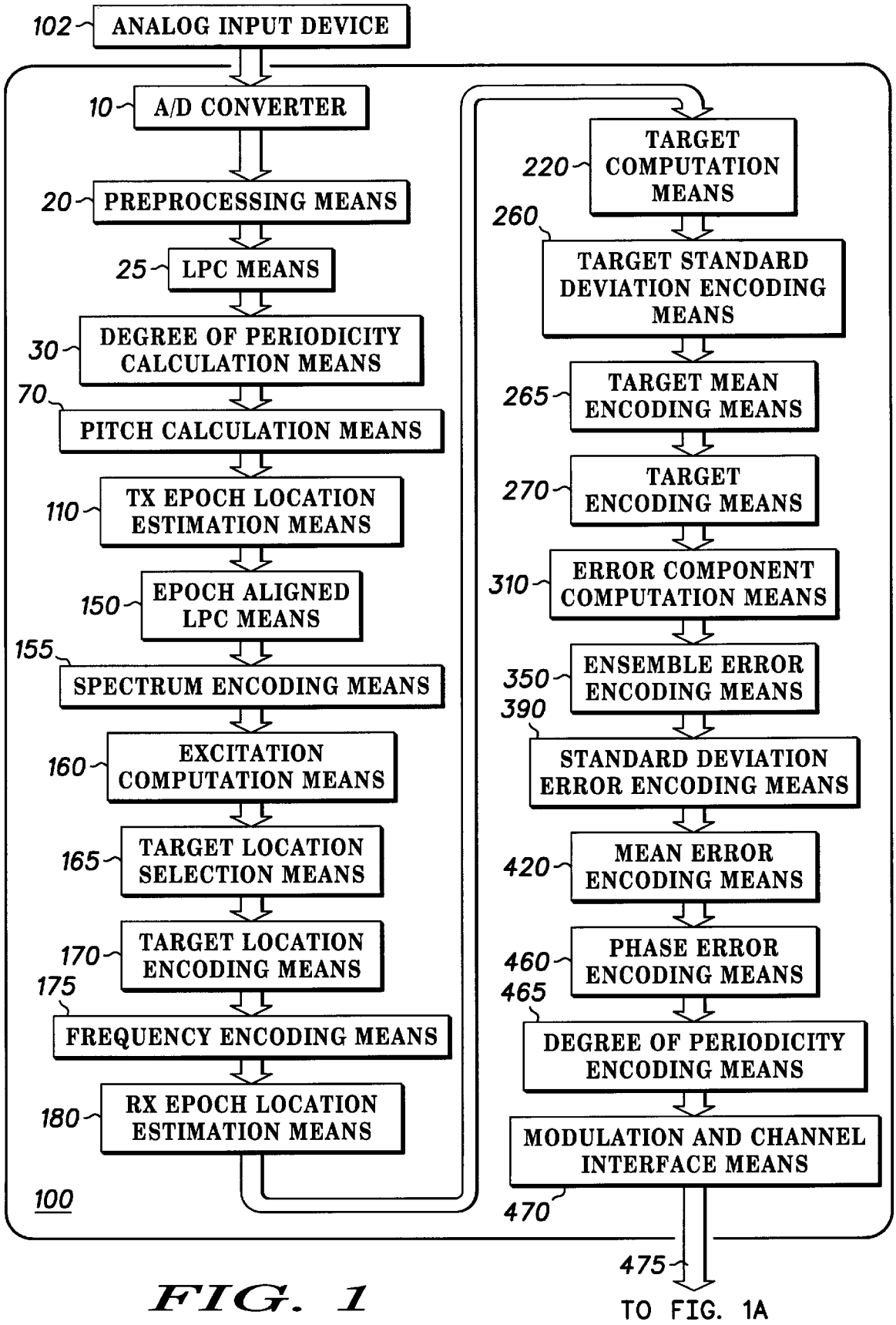
FIG. 1 illustrates a voice coding apparatus in accordance with a preferred embodiment of the present invention.
Figure 1A:
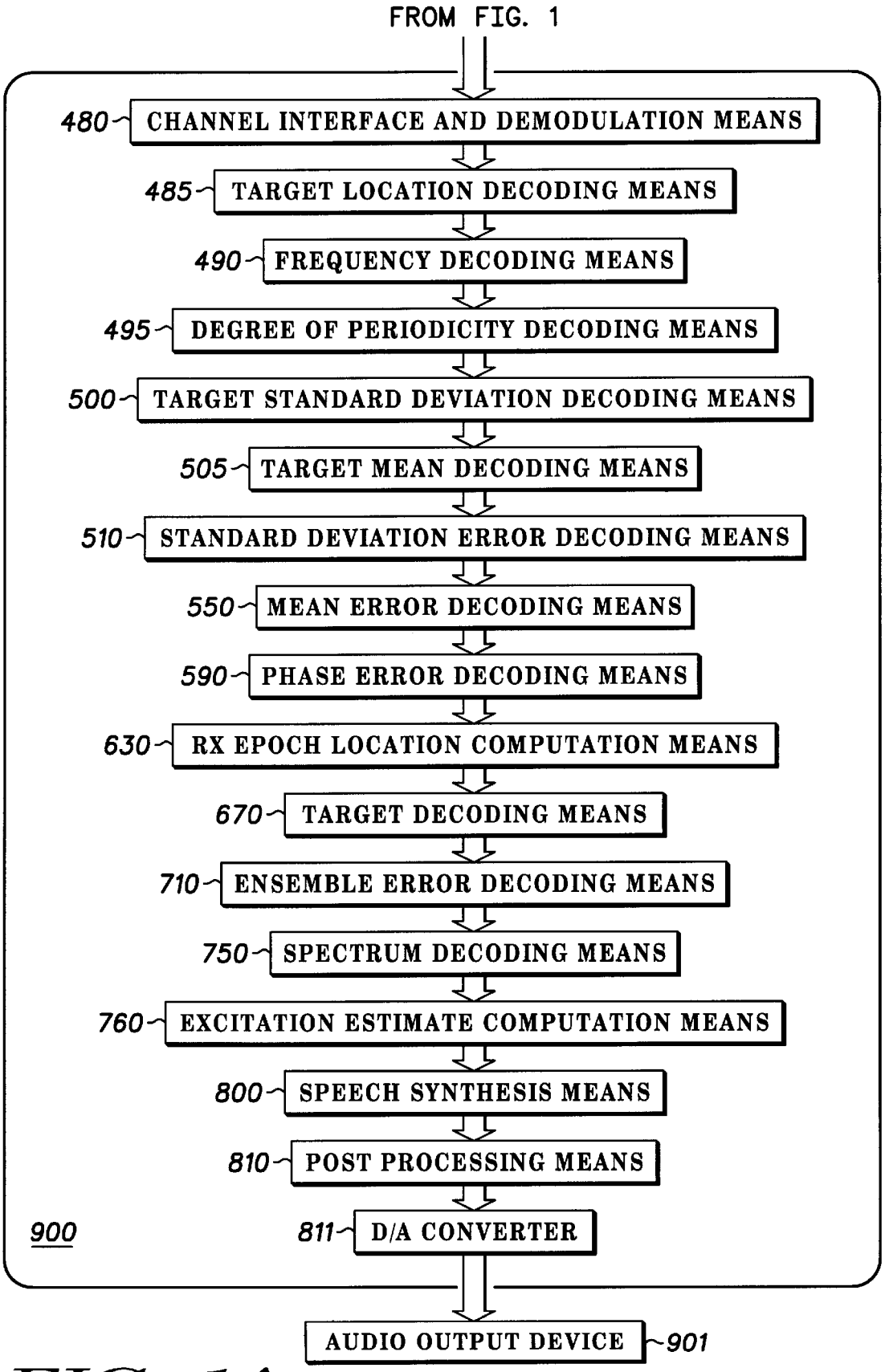

FIG. 1 illustrates a voice coding apparatus in accordance with a preferred embodiment of the present invention. The voice coding apparatus includes Analysis Processor 100 and Synthesis Processor 900. Analysis Processor 100 encodes input speech which can either originate from a human speaker or be retrieved from a memory device (not shown). Ultimately, the encoded speech is sent to Synthesis Processor 900 over Channel 475. Channel 475 can be a hard-wired connection, a PSTN network, a radio frequency (RF) link, an optical or optical fiber link, a satellite system, or any combination thereof.

Synthesis Processor 900 decodes the received, encoded speech, resulting in synthesized speech. Synthesis Processor 900 can then output the synthesized speech to Audio Output Device 901, which can be, for example, a speaker, producing output speech audio Alternatively, Synthesis Processor 900 can store the synthesized speech in a memory device (not shown).

FIG. 1 illustrates speech data being sent in one direction only (i.e., from Analysis Processor 100 to Synthesis Processor 900. This provides "simplex" (i.e., one-way) communication. In an alternate embodiment, "duplex" (i.e., two-way) communication can be provided. For duplex communication, another encoding device (not shown) can be co-located with Synthesis Processor 900. The other encoding device could encode speech data and send the encoded speech data to another decoding device (not shown) co-located with Analysis Processor 100. Thus, terminals that include both an encoding device and a decoding device could both send and receive speech data.

Referring again to FIG. 1, input speech is first processed by Analog Input Device 102 which converts the input speech into an electrical analog signal. A/D Converter 10 then converts the electrical analog signal into a stream of digital samples. The digital samples are operated upon by Pre-processing Means 20, which performs functions such as high-pass filtering, adaptive filtering, and removal of spectral tilt. Following Pre-processing Means 20, in a preferred embodiment, Frame-Synchronous LPC Means 25 performs linear predictive coding analysis and inverse filter operating on a frame of input speech to produce a frame-synchronous excitation waveform corresponding to the frame of speech under analysis. This first spectral model is optional, and, in an alternate embodiment, could be replaced by a somewhat modified algorithm structure which reduces computational complexity.

Frame Synchronous LPC Means 25 is followed by Degree Of Periodicity Calculation Means 30, which computes a discrete degree of periodicity for the frame of speech under analysis. In a preferred embodiment, a low-level multi-layer perceptron classifier is used to calculate degree of periodicity and direct codebook selection for the coded parameters. The neural network classifier is used to direct the algorithm toward either "more random" or "more periodic" codebooks for those parameters which can benefit from classification. Since the classifier primarily directs codebook selection, and does not impact the underlying modeling methods, the speech coding algorithm is relatively insensitive to misclassification.

FIG. 2 illustrates Multi-Layer Perceptron (MLP) Classifier structure 35 in accordance with a preferred embodiment of the present invention. MLP Classifier 35 provides excellent class discrimination, is easily modified to support alternate feature sets and speech databases, and provides much more consistent results over prior-art, threshold-based methods.

MLP Classifier 35 derived neural weights in an off-line backpropagation process well known to those of skill in the art The classifier uses a four-element feature vector, normalized to unit variance and zero mean, implemented on a two-subframe basis to provide a total of eight input features to the neural network.

These features are: (1) peak forward-backward subframe autocorrelation coefficient (over the expected pitch range), (2) subframe four pole LPC gain, (3) subframe low-band to high-band energy ratio (lowpass at 1 kHz/t highpass at 3 kHz), and (4) ratio of subframe energy to the maximum of N prior periodic subframe energies, where N is on the order of 100 for a subframe size of 15 milliseconds (ms).

The calculation of subframe features provides improved discrimination capability at class transition boundaries and further improves performance by providing a simple form of feature context. In addition to the use of subframe features, improved discrimination against "near-silence" conditions is obtained by including a very low level, zero-mean gaussian component prior to a feature calculation step. This low-level component (e.g., sigma=25.0), biases the features in low-energy conditions, and provides for rejection of inaudible sinusoidal signal components which could be interpreted as class periodic.

A preferred embodiment of the classifier was trained on a large, labeled database in excess of 10,000 speech frames in order to ensure good performance over a wide range of input speech data. Testing using a 5000 frame database outside the training set indicates a consistent accuracy rate of approximately 99.8%.

FIG. 3 illustrates a method for calculating the degree of periodicity in accordance with a preferred embodiment of the present invention, which is performed by Degree of Periodicity Calculation Means 30. The method begins with Compute Features step 31, which computes the four classifier features. Compute Features step 31 is followed by Load Weights step 32, which loads the weights from memory which were calculated in the off-line backpropagation process. Compute MLP Output step 33 uses the weights and computed features to compute the output of the multi-layer perceptron classifier. Compute Degree of Periodicity step 34 then scalar quantizes the output of Compute MLP Output step 33 to one of multiple degree-of-periodicity levels.

Referring again to FIG. 1, Degree of Periodicity Calculation Means 30 is followed by Pitch Calculation Means 70. Prior-art excitation-based methods based on processing the LPC residual for pitch determination have long proven to be unreliable for certain portions of voiced speech, especially for speech which is readily predicted by an all-pole model. In a preferred embodiment, a pitch detection technique accurately determines pitch directly from the speech waveform, eliminating problems associated with prior-art, excitation-based pitch detection methods. An accurate estimate of pitch is computed directly from subframe autocorrelation (e.g., 15 ms subframe segments) of low-pass filtered speech (e.g., 5 pole, low-pass Chebyshev, 0.1 dB ripple, 1000 Hz cutoff).

Consistent pitch estimates are computed using this technique. Half-frame forward and backward subframe correlations are especially useful for onset and offset situations, in that they reduce the random bias introduced by the presence of nonperiodic transition data.

Figure 4:
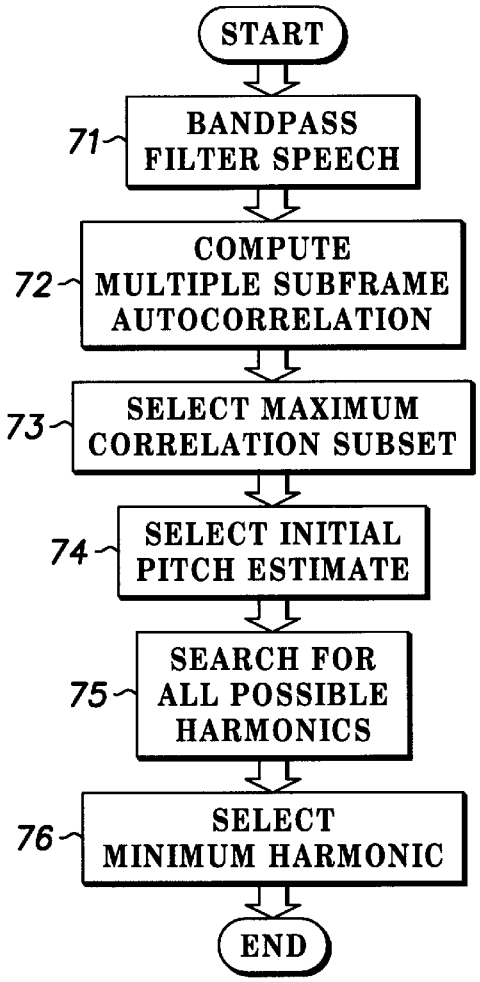
FIG. 4 illustrates a method for calculating pitch in accordance with a preferred embodiment of the present invention.

FIG. 4 illustrates a method for calculating pitch in accordance with a preferred embodiment of the present invention, which is performed by Pitch Calculation Means 70. The method begins with Bandpass Filter Speech step 71, wherein the input speech is filtered using a bandpass filter (e.g., with cutoffs at 100 Hz and 1000 Hz).

After filtering, Compute Multiple Subframe Autocorrelations step 72 computes a family of correlation sets using multiple subframe segments (e.g., two or more) of the segment of speech under analysis. Following Compute Multiple Subframe Autocorrelations step 72, Select Maximum Correlation Subset step 73, searches each of the subframe correlation sets and selects the set encompassing the maximum correlation coefficient $\rho_{max}$.

Figure 5:
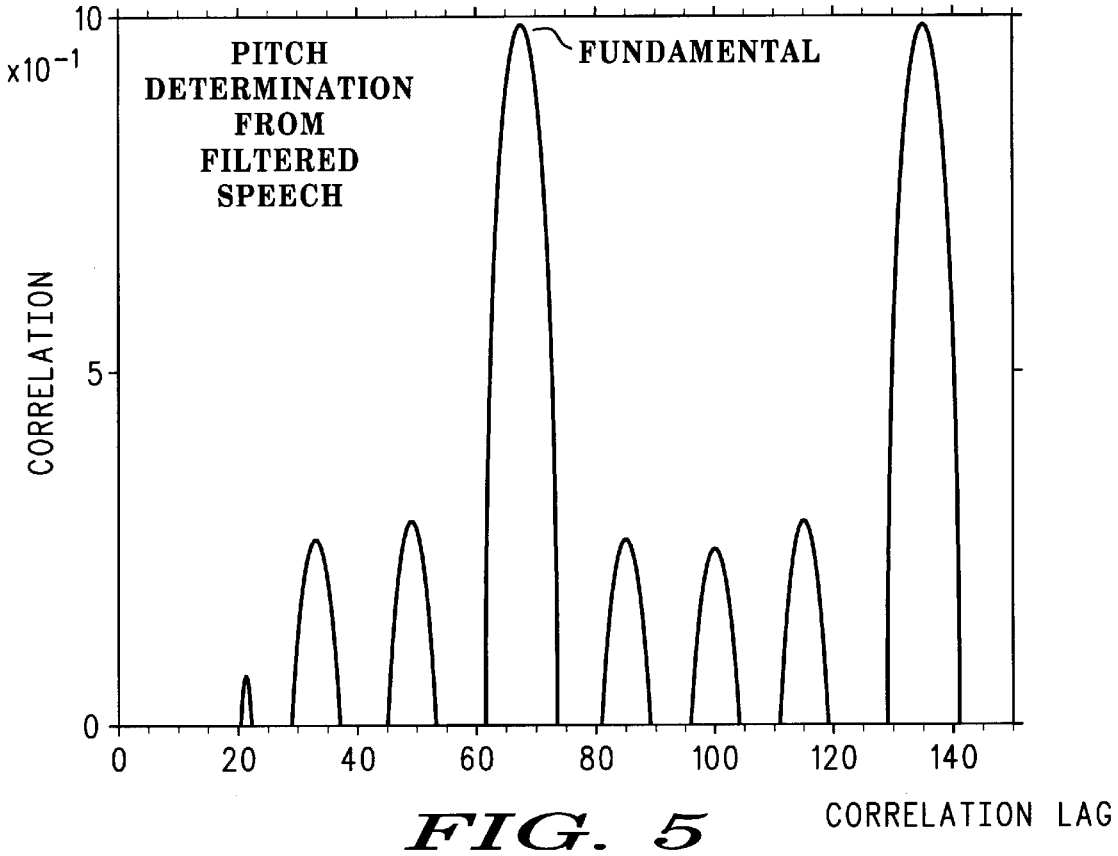
FIG. 5 illustrates a candidate correlation set for a highly periodic frame derived in accordance with a preferred embodiment of the present invention.
Figure 6:
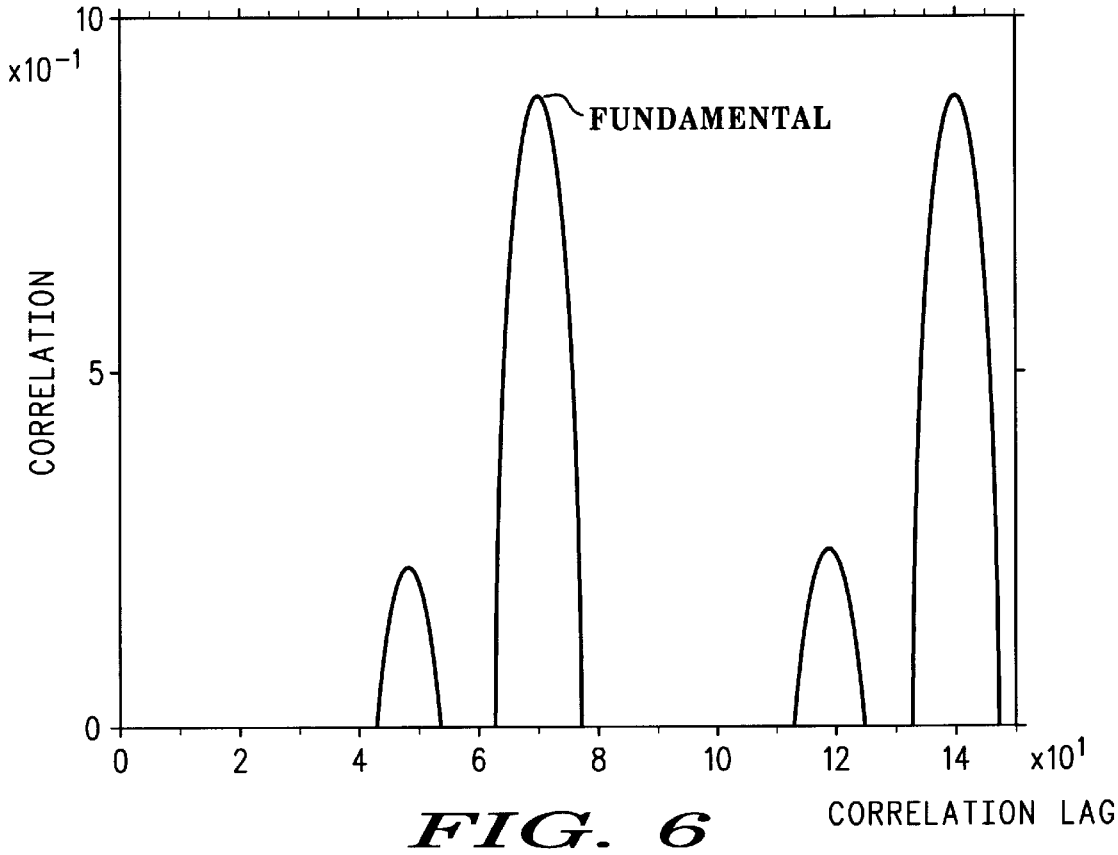
FIG. 6 illustrates a candidate correlation set for a transition frame derived in accordance with a preferred embodiment of the present invention.

FIG. 5 illustrates a candidate correlation set for a highly periodic speech frame (i.e., highly-voiced) derived in accordance with a preferred embodiment of the present invention. Correspondingly, FIG. 6 illustrates a candidate correlation set for a transition frame derived in accordance with a preferred embodiment of the present invention. In contrast to problems encountered using excitation for pitch determination, onset and offset speech correlations maintain a useful harmonic pattern, which is augmented by the subframe analysis.

Following the selection of a candidate correlation set from the subframe correlations, an initial pitch estimate, is selected in Select Initial Pitch Estimate step 74, which corresponds to the offset lag corresponding to $\rho_{max}$. Given this pitch estimate, Search For All Possible Harmonics step 75 examines the correlation data for evidence of N possible harmonic patterns, each aligned with the maximum positive correlation. Naturally, a limited amplitude and lag variance relative to the peak correlation is tolerated.

In a preferred embodiment, candidate harmonics are identified only if:

$$\rho_i > \rho_{max} * \alpha, \text{ where } \alpha = 0.9, \text{ for example.}$$

After all possible harmonics are identified, Select Minimum Harmonic step 76 sets the pitch equal to a minimum identified harmonic lag. Pitch contour smoothing can be implemented later if necessary as a companion post process.

Referring again to FIG. 1, Pitch Calculation Means 70 is followed by Transmitter (Tx) Epoch Location Estimation Means 110, which uses the input speech from Preprocessing Means 20, frame-synchronous excitation from Frame-Synchronous LPC Means 25, and pitch period determined from Pitch Calculation Means 70 to determine excitation epoch locations, wherein an epoch refers to a pitch synchronous segment of excitation corresponding to the pitch period. In a preferred embodiment, a three-stage epoch position detection algorithm is used, whereby low-pass filtered speech, unfiltered speech, and preliminary excitation waveform are searched in a sequential fashion. The staged approach determines speech epoch indices directly from the filtered and unfiltered speech waveforms, and refines the estimate by using those indices as a mapping into the excitation waveform, where the index is finalized via a localized search. In order to avoid positive/negative peak switching which can occur due to waveform variance, the algorithm first determines a dominant "sense", either positive or negative, and rectifies the waveform to preserve the identified sense.

Figure 7:
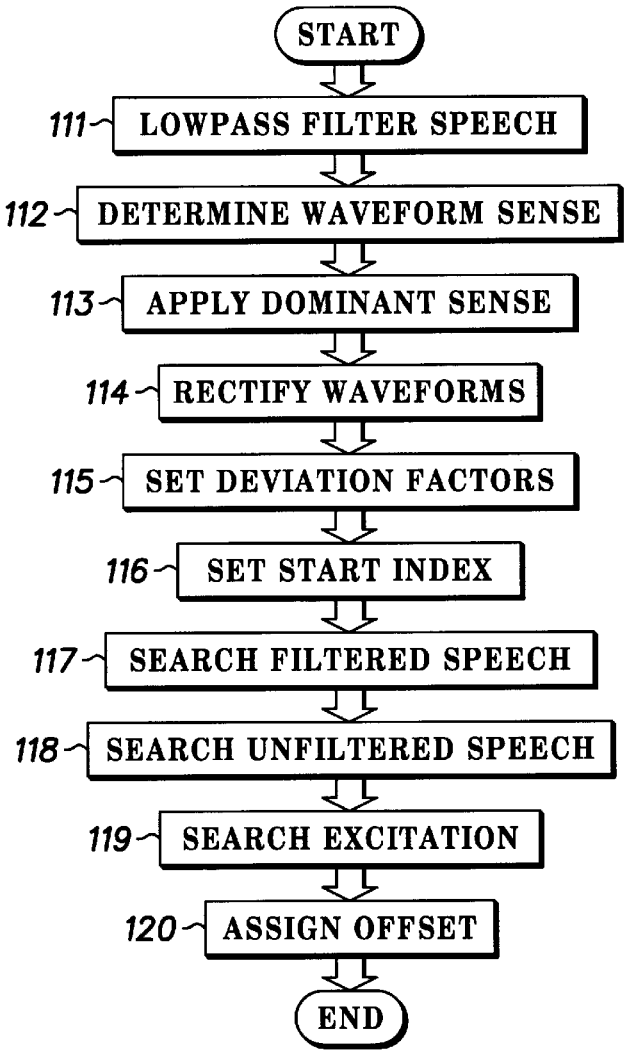
FIG. 7 illustrates a method for estimating transmitter epoch locations using a three stage analysis in accordance with a preferred embodiment of the present invention.

FIG. 7 illustrates a method for estimating transmitter epoch locations using a three stage analysis in accordance with a preferred embodiment of the present invention performed by Tx Epoch Location Estimation Means 110. The method begins with Lowpass Filter Speech step 111, where a lowpass filter is applied to the input speech waveform to produce a filtered speech waveform. Lowpass Filter Speech step 111 includes storing the original speech to memory for later reference.

Following Lowpass Filter Speech step 111, Determine Waveform Sense step 112 searches the speech waveform, the lowpass filtered speech waveform, and the excitation waveform for the dominant sense of each waveform, wherein sense refers to the primary sign of the waveforms under analysis. A preferred embodiment of this method searches for the maximum positive or negative extent for each waveform and assigns the sign of the extent to the sense for each waveform.

After Determine Waveform Sense step 112, Apply Dominant Sense step 113 multiplies the excitation waveform, the speech waveform, and the filtered speech waveform by the sense associated with each waveform. Then, the excitation waveform, speech waveform, and filtered speech waveform is rectified in Rectify Waveforms step 114.

Set Deviation Factors step 115 then sets the appropriate pitch search factor for each waveform, where each factor represents the range of pitch period over which waveform peaks are to be determined. For example, the pitch search range factor for filtered speech could be set at 0.5, the search range factor for the speech waveform could be set at 0.3, and the search range factor for the excitation waveform could be set at 0.1. Hence, the search range of each subsequent stage is narrowed in order to restrict the peak search for that stage. Furthermore, Set Deviation Factors step 115 can take into account the degree-of-periodicity when assigning range factors by restricting search range for aperiodic data.

After Set Deviation Factors step 115, Set Start Index step 116 sets the starting index for the peak search. A starting index is desirably assigned to be the ending index of the prior frame, minus the frame length. Search Filtered Speech step 117 then searches the filtered speech for peaks at pitch intervals from the starting index over the range of samples determined by the search range factor assigned in Set Deviation Factors step 115, producing indices corresponding to filtered speech epoch locations. Search Unfiltered Speech step 118 uses the indices determined in Search Filtered Speech step 117 as start indices, searching the unfiltered speech for peaks over a range of samples determined by the second search range factor, producing indices corresponding to unfiltered epoch locations. Search Excitation step 119 uses the indices determined in Search Unfiltered Speech step 118 as start indices, searching the excitation for peaks over the range of samples determined by the third search range factor, producing excitation epoch locations.

Figure 8:
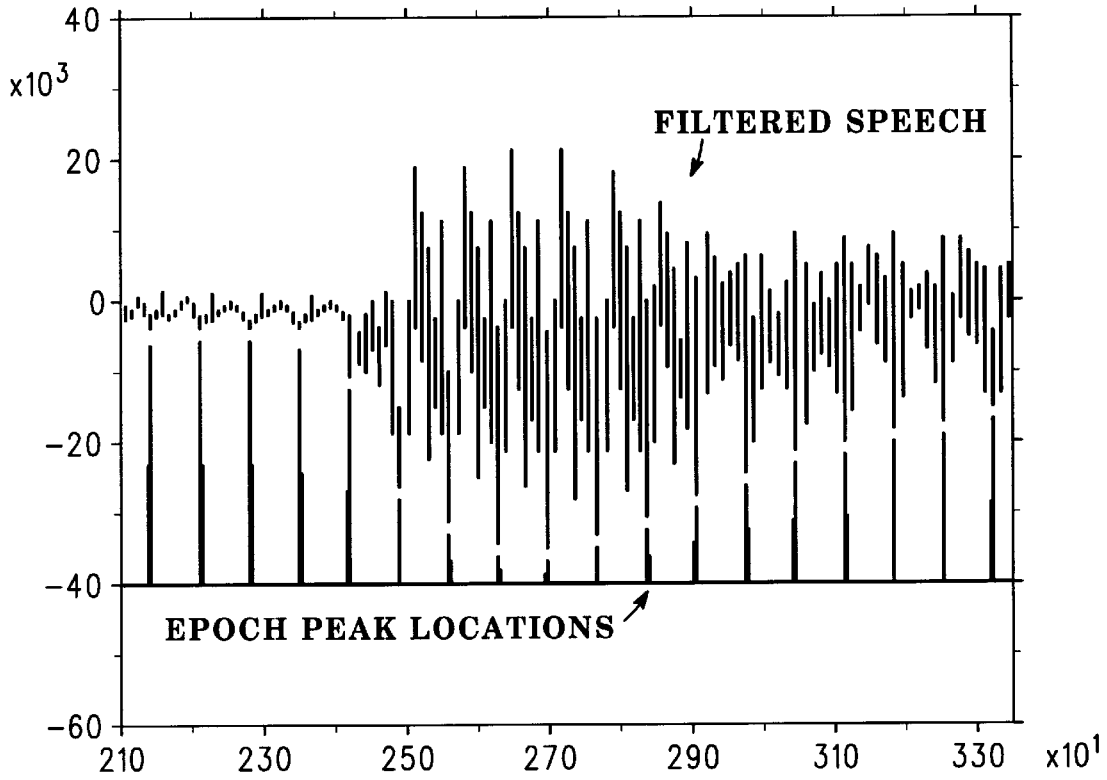
FIG. 8 illustrates first stage epoch locations determined from filtered speech derived in accordance with a preferred embodiment of the present invention.
Figure 9:
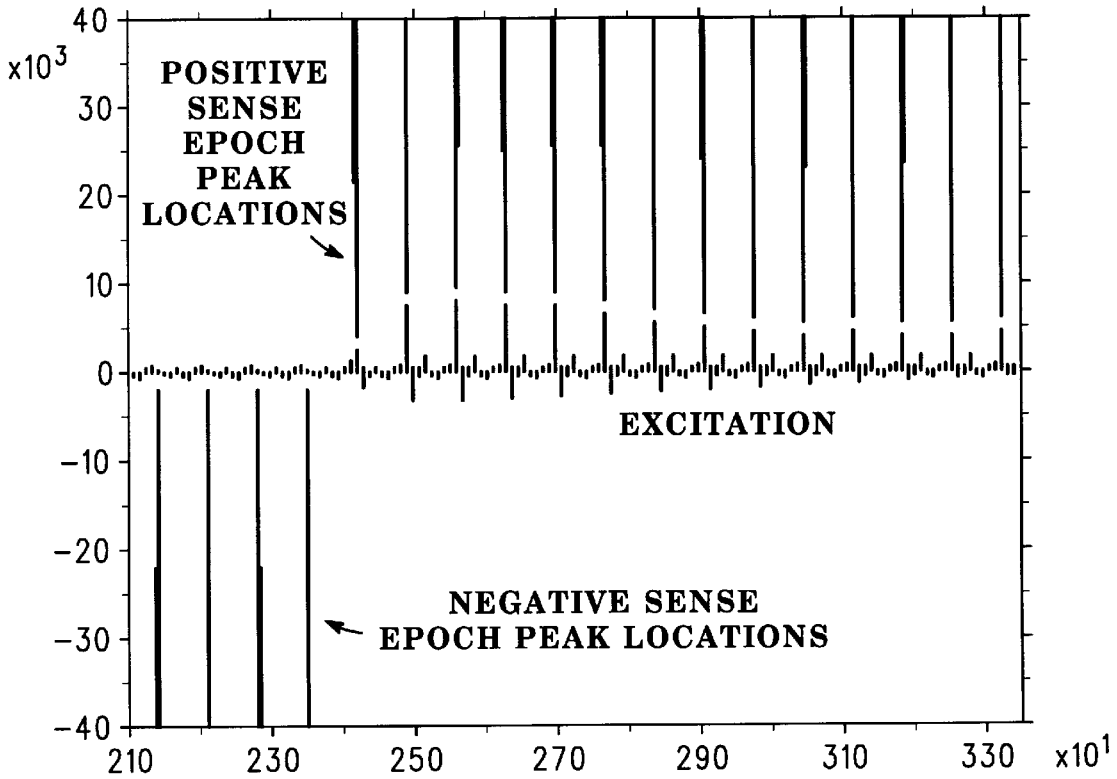
FIG. 9 illustrates third stage epoch locations determined from the excitation waveform derived in accordance with a preferred embodiment of the present invention.

Following Search Excitation step 119, Assign Offset step 120 applies a desired offset to each of the excitation epoch peak locations to produce epoch locations, for example 0.5 * pitch, although other offsets could also be appropriate. FIG. 8 illustrates epoch peak locations of filtered speech, and FIG. 9 illustrates excitation epoch peak locations derived using a preferred embodiment of the method. Note from the figures that the staged method works well to provide an accurate index from the speech waveform into the corresponding excitation portion. In addition to epoch locations, Tx Epoch Location Estimation Means 110 produces an estimate of the number of epochs within the segment under analysis.

Referring back to FIG. 1, following Tx Epoch Location Estimation Means 110, Epoch Aligned LPC Means 150 uses the estimated epoch locations to compute second LPC parameters corresponding to a segment of speech aligned with the estimated epoch locations. In this manner, the excitation model corresponds directly with the spectral model for the segment of speech under analysis. Epoch Aligned LPC Means 150 produces line spectral frequencies corresponding to the segment of speech under analysis, although other representations could also be appropriate (e.g., reflection coefficients).

Following Epoch Aligned LPC Means 150, Spectrum Encoding Means 155 encodes the spectral parameters corresponding to the segment of speech under analysis, producing a code index and quantized spectral parameters. Spectrum Encoding Means 155 can use vector quantization or multi-stage vector quantization techniques well-known to those of skill in the art. In a preferred embodiment of the invention, Spectrum Encoding Means 155 selects from codebooks corresponding to each of the discrete degrees-of-periodicity produced by Degree of Periodicity Calculation Means 30, although a non-class-based approach could also be appropriate.

Following Spectrum Encoding Means 155, Excitation Computation Means 160 uses an inverse filter described by the quantized spectral parameters to compute a second excitation waveform. Target Location Selection Means 165 then uses the second excitation waveform computed in Excitation Computation Means 160 to determine a target location corresponding to a representative segment of excitation consisting of a single pitch period. Target Location Selection Means 165 produces an integer representing the sample index.

A problem associated with periodic excitation models is the introduction of error to the reconstructed excitation waveform. Such error can be manifest in the form of significant envelope/energy deviations relative to the waveform being modeled. Interpolation error variance can be larger than necessary due to random selection of interpolation target, leading to audible envelope/energy modulation artifacts in the absence of error modeling.

Deterministic target selection in accordance with the present invention can correct problems associated with random target selection. Possible methods, for example, could include a variance analysis of each candidate target epoch energy relative to the previously determined source energy, or analysis of the source-target peak interpolation envelope relative to the original peak excitation envelope. Proper selection of target position minimizes variance of the modeled error waveforms, and hence improves error quantization efficiency.

Following Target Location Selection Means 165, Target Location Encoding Means 170 encodes the target location using a scalar quantizer, producing a code index and quantized target location.

Next, Frequency Encoding Means 175 scalar quantizes the number of epochs determined in Tx Epoch Location Estimation Means 110, and produces a code index and quantized number of epochs. Receiver (Rx) Epoch Location Estimation Means 180 then uses the quantized target location from Target Location Encoding Means 170, and the quantized number of epochs from Frequency Encoding Means 175, to estimate the epoch locations which will be derived at the receiver, producing a sequence of epoch locations with an effective normalized pitch for each epoch within one sample of the average pitch.

Figure 10:
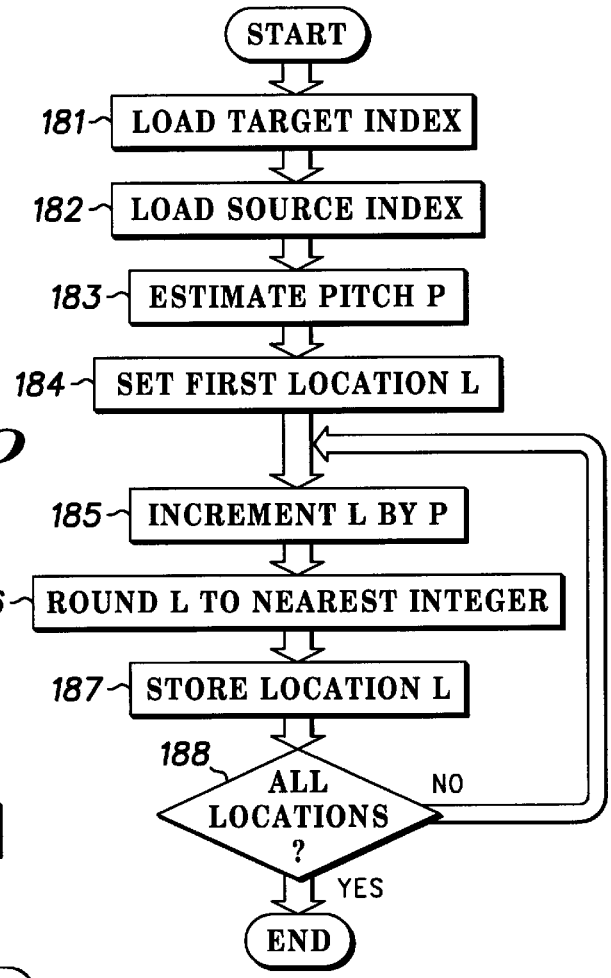
FIG. 10 illustrates a method for estimating receiver epoch locations in accordance with a preferred embodiment of the present invention.

FIG. 10 illustrates a method for estimating receiver epoch locations in accordance with a preferred embodiment of the present invention performed by Rx Epoch Location Estimation Means 180. The method begins with Load Target Index step 181, which loads from memory the target index, ti, determined in Target Location Encoding Means 170. Load Source Index step 182 loads from memory the previous target index, and subtracts the frame length to form the source index, si.

Estimate Pitch P step 183, uses the source index from Load Source Index step 182, the target index from Load Target Index step 181, and the number of epochs, ne, from Frequency Encoding Means 175, and computes the pitch, P, using the relation: P=(ti-si)/ne. Set First Location L step 184 sets the location pointer, L, to the first epoch location, corresponding to the source index, si.

Increment L by P step 185 then increments the location pointer by the pitch estimate, P, forming a next location estimate. The location estimate, L, is rounded to the nearest integer to reflect a proper sample index in Round L to Nearest Integer step 186. The location index is then stored to memory in Store Location L step 187. A determination is then made, in step 188, whether all locations have been computed. If not, the procedure branches as illustrated in FIG. 10. If so, the procedure then ends.

Figure 11:
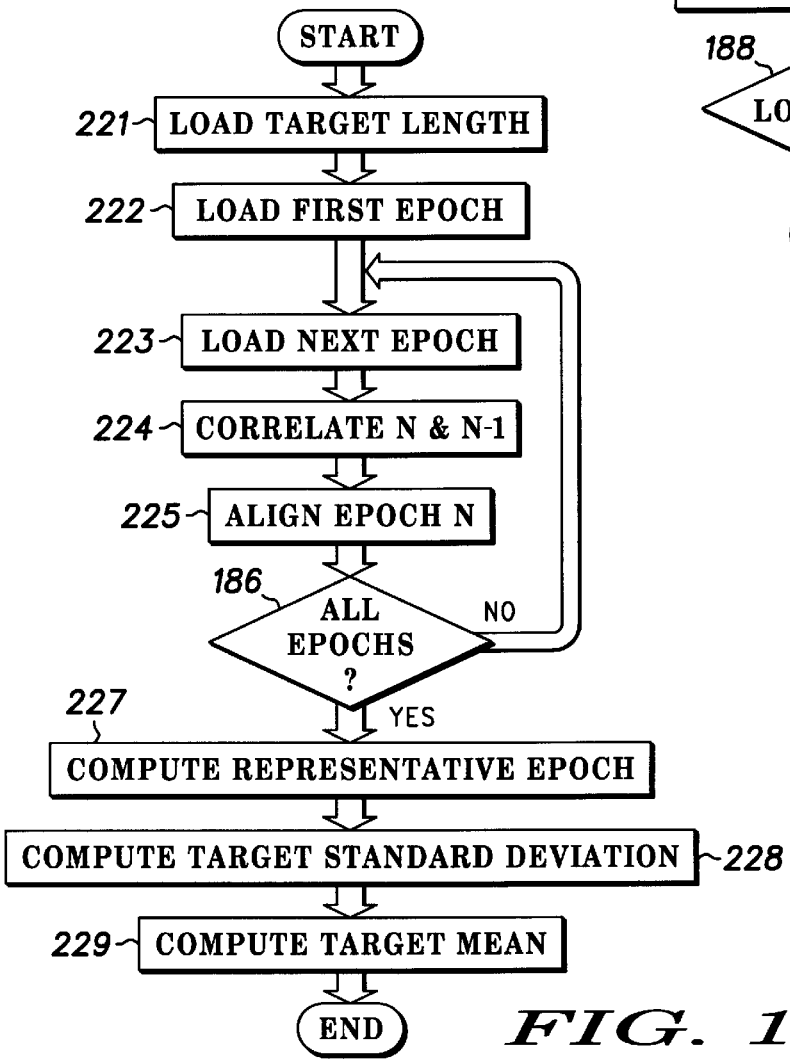
FIG. 11 illustrates a method for computation of target in accordance with a preferred embodiment of the present invention.

Following Rx Epoch Location Estimation Means 180, Target Computation Means 220 computes a representative pitch-synchronous excitation segment, or target, to represent the entire frame. FIG. 11 illustrates a method for computation of target in accordance with a preferred embodiment of the present invention performed by Target Computation Means 220. The method begins with Load Target Length step 221, which sets the target length equal to the final epoch segment length determined by Rx Epoch Location Estimation Means 180. Load First Epoch step 222 then copies the epoch corresponding to the first excitation epoch into a temporary buffer, and optionally normalizes the epoch to a uniform length via linear or non-linear interpolation.

Load Next Epoch step 223 repeats the procedure performed by Load First Epoch step 222 for the subsequent epoch, placing the epoch into the temporary buffer. Correlate N & N-1 step 224 correlates the current epoch (i.e., epoch N) in the temporary buffer with the adjacent epoch in the temporary buffer (i.e., epoch N-1), resulting in an array of correlation coefficients. Align Epoch step 225 then cyclically shifts epoch N by the lag corresponding to the maximum correlation in order to ensemble align epoch N with epoch N-1.

A determination is then made, in step 226, whether all epochs have been placed in the temporary buffer. If not, the procedure iterates as shown in FIG. 11. If so, Compute Representative Epoch step 227 performs an ensemble process which results in a single target epoch representative of the epochs within the frame. Compute Representative Epoch step 227 could compute an ensemble filter, an ensemble mean, or a synchronous matched-filter average which preserves the periodic portion of the segment under analysis.

Figure 12:
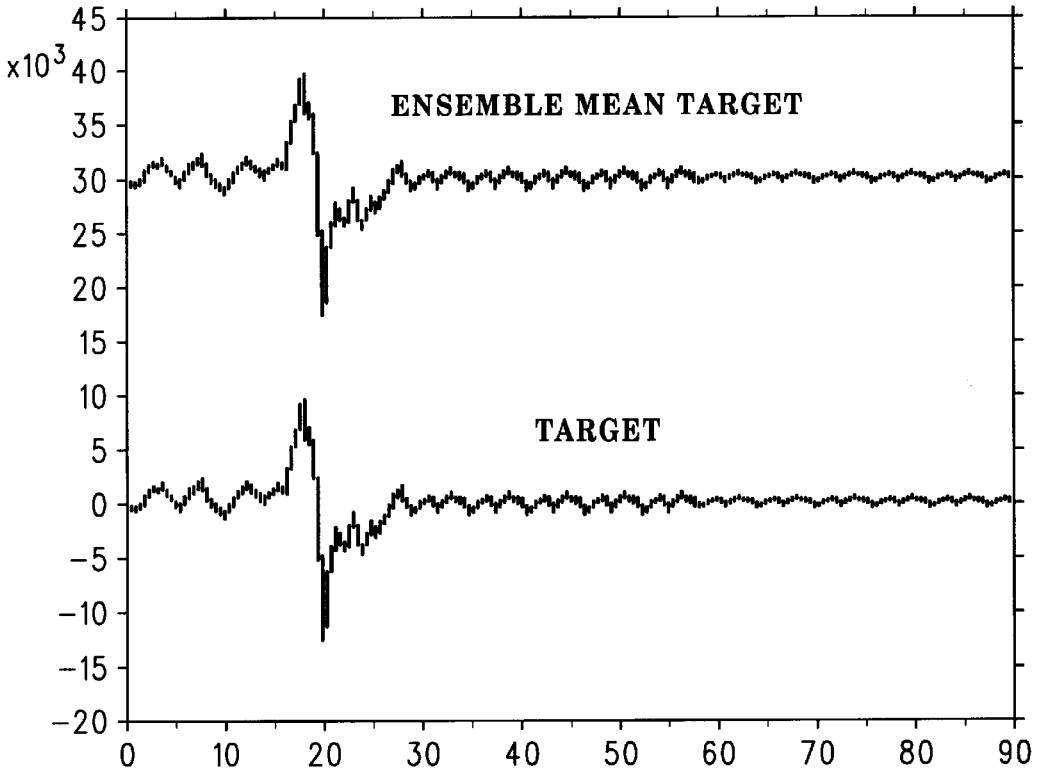
FIG. 12 illustrates a typical target derived using an ensemble-mean approach in accordance with a preferred embodiment of the present invention.

FIG. 12 illustrates a typical target derived using an ensemble-mean approach in accordance with a preferred embodiment of the present invention.

Prior-art research has illustrated that smooth, natural sounding speech can be synthesized from excitation which has been match-filtered (MF) on an epoch-synchronous basis. Application of this filtering process effectively removes nonlinear spectral phase information, resulting in a symmetric impulse which can be efficiently encoded.

Optimal filtering methods include a class of filters called "matched" filters. Such filters maximize the output signal-to-noise ratio over a symbol interval, T. The correlation characteristics inherent to this type of filter are commonly applied toward optimum detection of signals. One type of optimal matched filter that assumes white noise is defined by:

$$\text{(EQ 1)}\ H_{opt}(\omega)=KX^*(\omega)e^{-j\alpha T}$$

where $X(\omega)$ is the input signal spectrum and K is a constant. Given the conjugation property of Fourier transforms: $x^*(-t) \leftrightarrow X^*(\omega)$, the impulse response of the optimum filter is given by:

$$\text{(EQ 2)}\ h_{opt}(t)=Kx^*(T-t)$$

Figure 13:
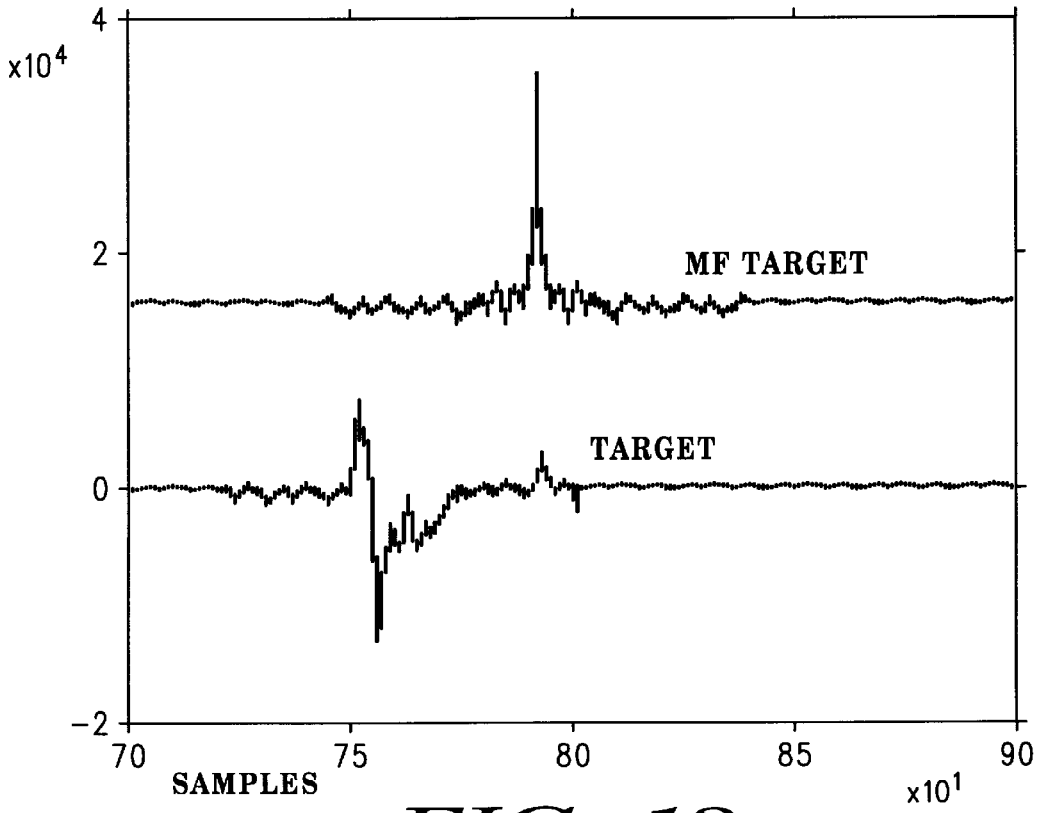
FIG. 13 illustrates a typical target derived using a matched-filter approach in accordance with a preferred embodiment of the present invention.

In order to apply the above relationships to the excitation compression problem, it is convenient to consider the template excitation epoch to be a "symbol" x(t). Furthermore, the symbol interval, T, of the matched filter is conveniently considered to be the epoch period. Hence, the matched compression filter coefficients are determined directly from EQ 2. The group delay characteristics of EQ 2 serve to cancel the group delay characteristics of the template and proximity excitation epochs. FIG. 13 illustrates a typical target derived using a matched-filter approach in accordance with a preferred embodiment of the present invention.

Referring back to FIG. 11, following Compute Representative Epoch step 227, Compute Target Standard Deviation step 228 computes the standard deviation of the representative target, and Compute Target Mean step 229 computes the mean of the representative epoch. Referring again to FIG. 1, Target Computation Means 220 is followed by Target Standard Deviation Encoding Means 260, which scalar quantizes the target standard deviation, producing a code index and the quantized standard deviation value. In a preferred embodiment of the invention, Target Standard Deviation Encoding Means 260 selects from codebooks corresponding to each of the discrete degrees-of-periodicity produced by Degree of Periodicity Calculation Means 30, although a non-class-based approach could also be appropriate.

Target Standard Deviation Encoding Means 260 is followed by Target Mean Encoding Means 265, which scalar quantizes the target mean, producing a code index and the quantized mean value. In a preferred embodiment of the invention, Target Mean Encoding Means 265 selects from codebooks corresponding to each of the discrete degrees-of-periodicity produced by Degree of Periodicity Calculation Means 30, although a non-class-based approach could also be appropriate.

Next, Target Encoding Means 270 uses the quantized standard deviation from Target Standard Deviation Encoding Means 260, the quantized mean from Target Mean Encoding Means 265, and the target from Target Computation Means 220 to encode the target vector, producing one or more code indices and the quantized target vector.

Figure 14:
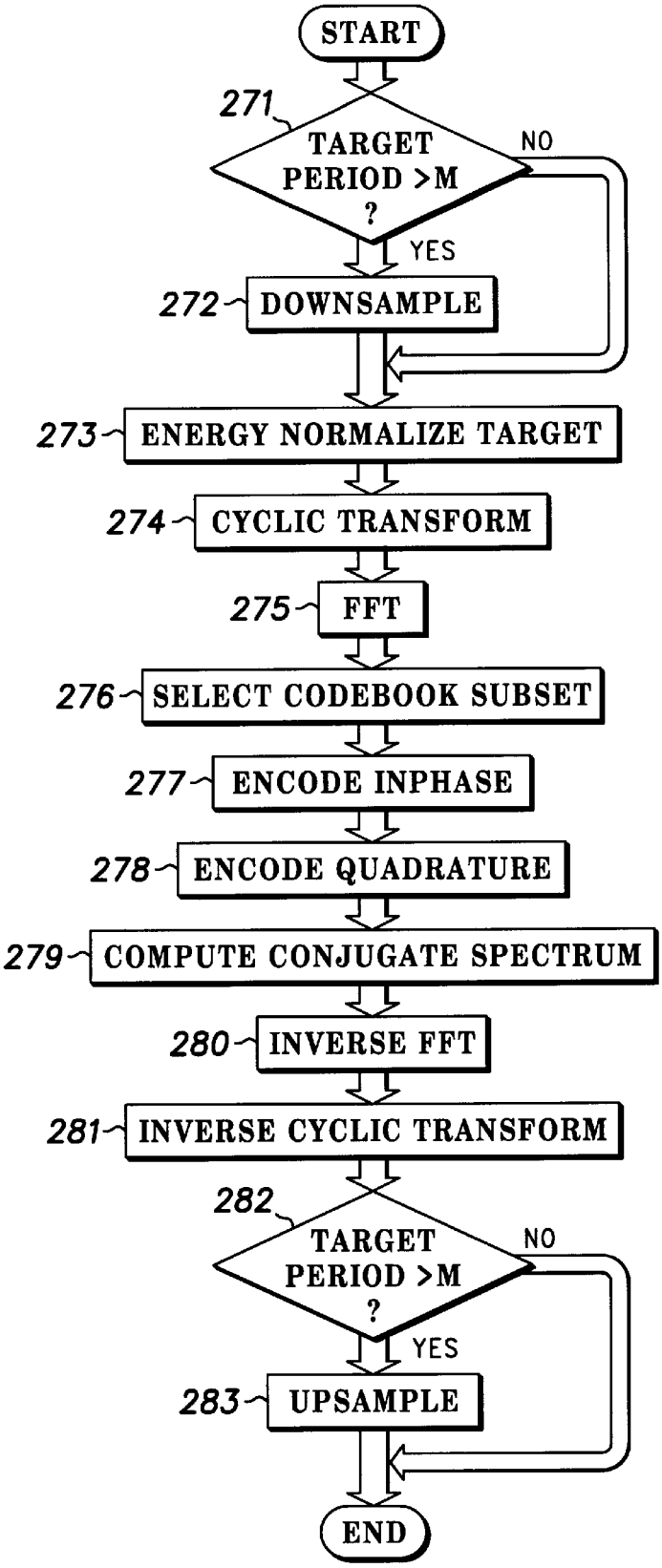
FIG. 14 illustrates a method for encoding the calculated target in accordance with a preferred embodiment of the present invention.

FIG. 14 illustrates a method for encoding the calculated target in accordance with a preferred embodiment of the present invention which is performed by Target Encoding Means 270. The method begins by determining whether Target Period>M 271 in step 271. A check is made whether the target is greater than M samples in length, where M corresponds to the Fast Fourier Transform (FFT) size used for characterization of the target, typically a power of two.

If the target length exceeds FFT size M, Downsample step 272 is performed, which downsamples the representative target epoch to M samples. If the target length does not exceed FFT size M, or after Downsample step 272 is performed, Energy Normalize Target step 273 subtracts the target mean from each target sample and divides each target sample by the target standard deviation, producing a zero-mean, unit-variance target vector.

Next, Cyclic Transform step 274 pre-processes the target vector prior to frequency domain transformation in order to minimize frequency domain variance.

Figure 15:
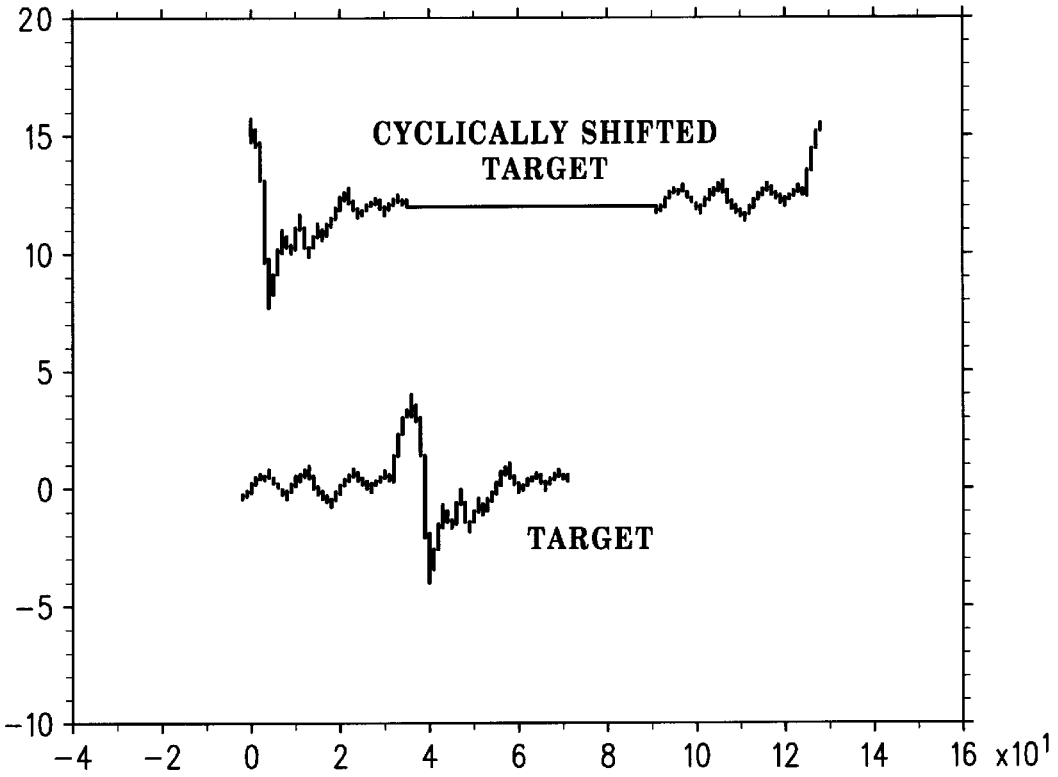
FIG. 15 illustrates a target which has been cyclically shifted in accordance with a preferred embodiment of the present invention.

FIG. 15 illustrates a target which has been cyclically shifted in accordance with a preferred embodiment of the present invention.

Figure 16:
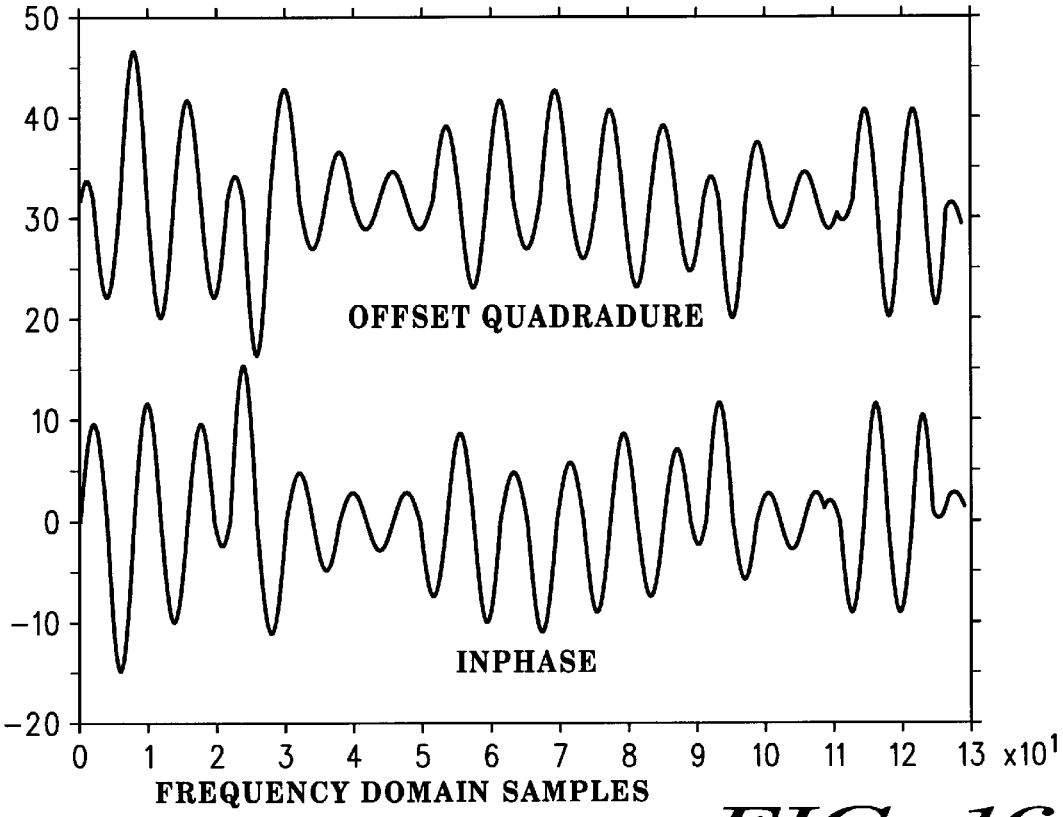
FIG. 16 illustrates the target inphase and quadrature components prior to a cyclical transform in accordance with a preferred embodiment of the present invention.
Figure 17:
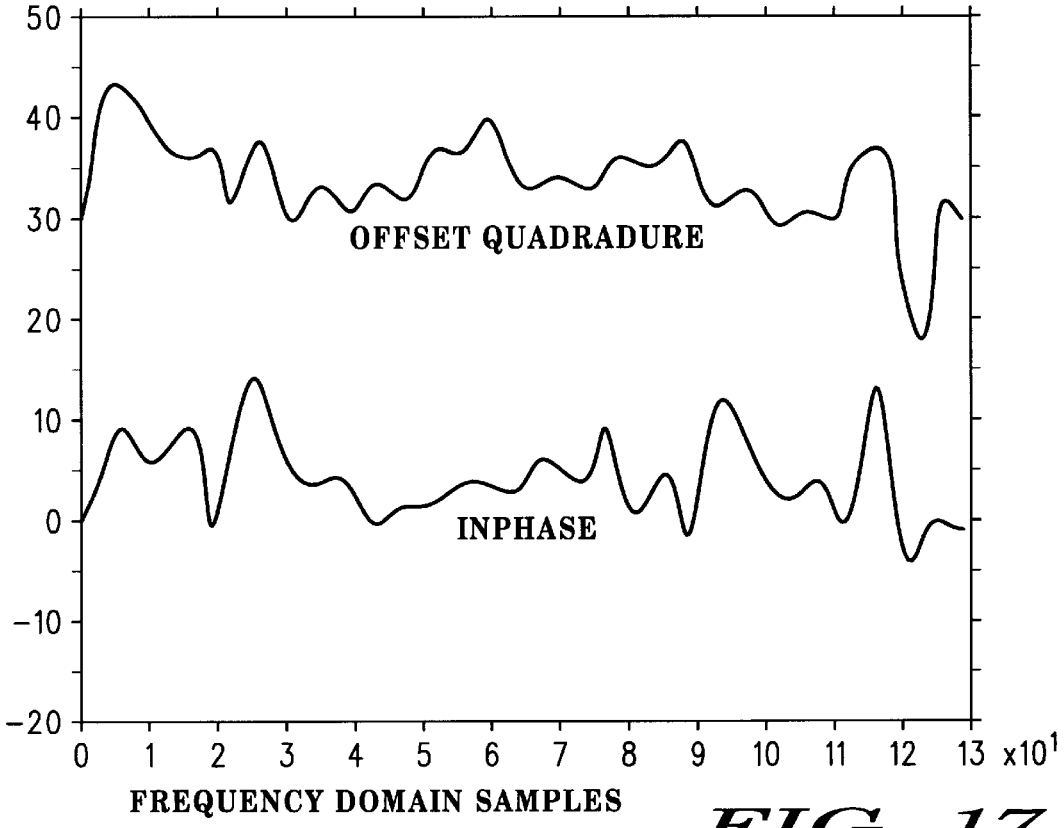
FIG. 17 illustrates the target inphase and quadrature components after a cyclical transform in accordance with a preferred embodiment of the present invention.
Figure 20:
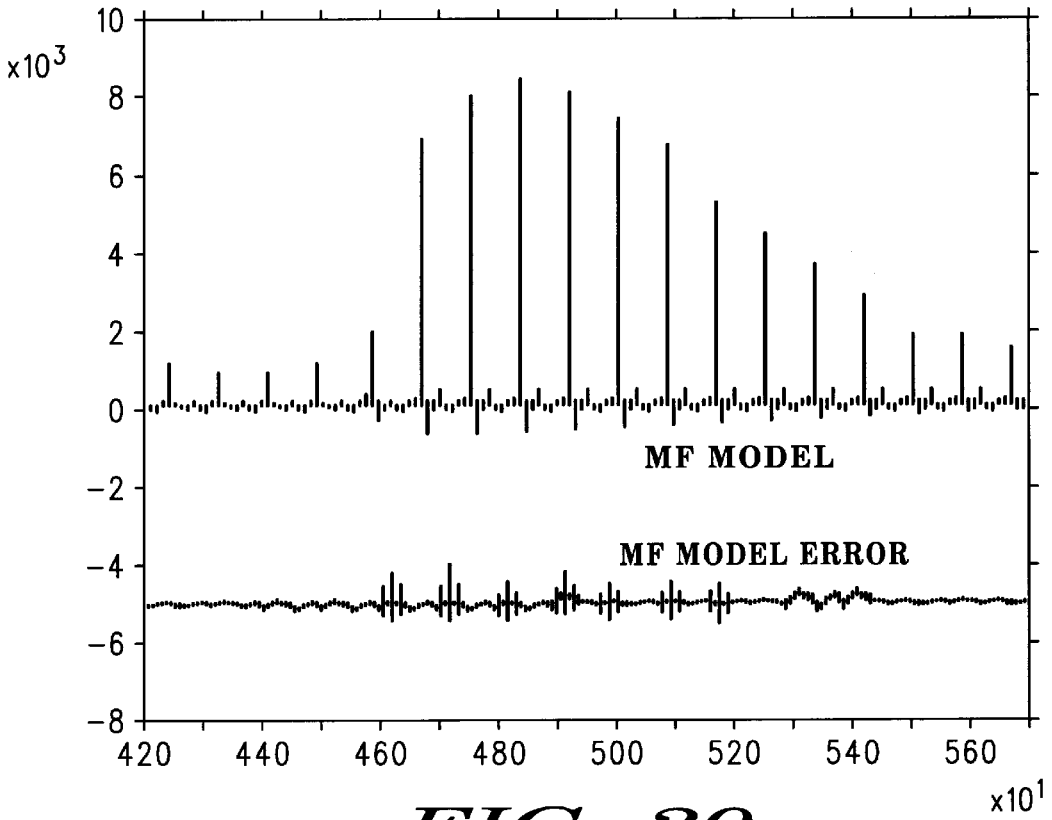
FIG. 20 illustrates a typical periodic model derived from the match-filtered target, and the typical ensemble error waveform derived from the match-filtered reference in accordance with a preferred embodiment of the present invention.
Figure 21:
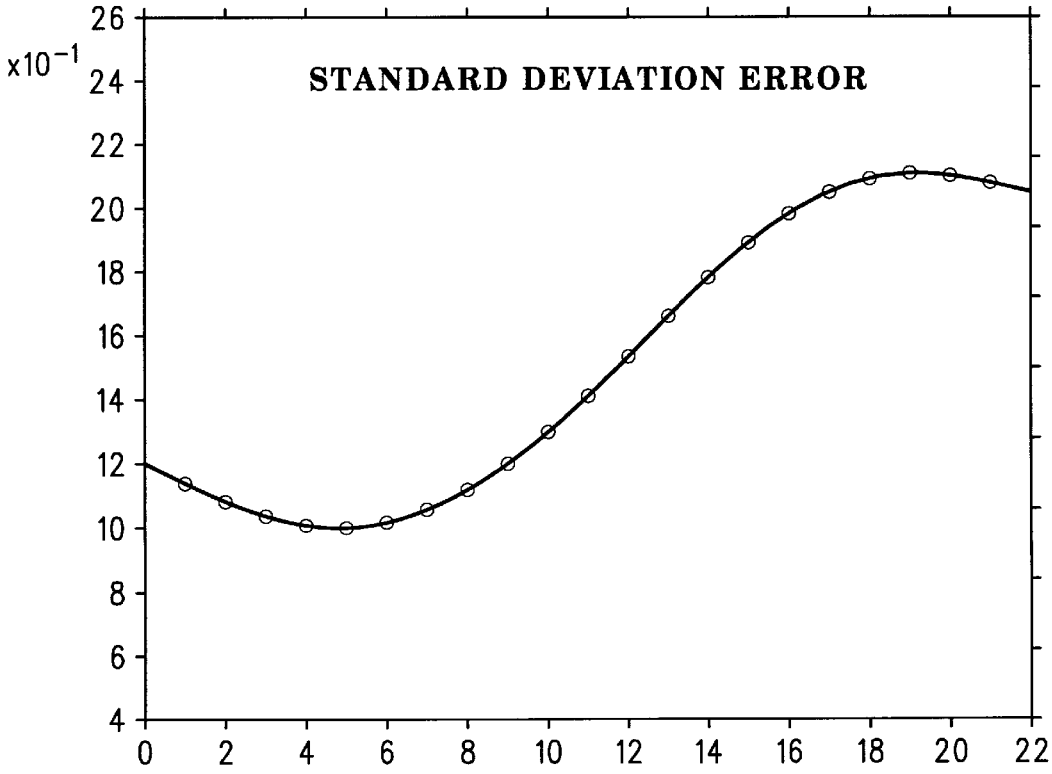
FIG. 21 illustrates a typical standard deviation error waveform derived in accordance with a preferred embodiment of the present invention.

The cyclic transform cyclically shifts the target peak to bin zero of the FFT vector, placing samples left of the peak at the end of the FFT vector. The frequency domain result of this process is illustrated in FIGS. 20 and 21. FIG. 16 illustrates the target inphase and quadrature components prior to a cyclical transform in accordance with a preferred embodiment of the present invention. FIG. 17 illustrates the target inphase and quadrature components after a cyclical transform in accordance with a preferred embodiment of the present invention. Note from FIG. 17 that the variance of the cyclically shifted inphase and quadrature is reduced, improving subsequent quantization performance.

FFT step 275 performs an M point FFT on the vector produced by Cyclic Transform step 274, producing inphase and quadrature frequency domain vectors. Following FFT step 275, Select Codebook Subset step 276 uses the degree of periodicity from Degree of Periodicity Calculation Means 30 to select the codebook subset corresponding to the identified class.

Following Select Codebook Subset step 276, Encode Inphase step 277 quantizes, at most, M/2+1 samples of the inphase data using appropriate quantization methods, such as vector quantization (VQ), split VQ, multi-stage VQ, wavelet VQ, Trellis-Coded Quantization (TCQ), or wavelet TCQ quantizers, producing at least one code index and a quantized inphase vector. Encode Inphase step 277 can also perform linear or nonlinear downsampling on the inphase vector in order to increase the bandwidth-per-sample.

Next, Encode Quadrature step 278 quantizes, at most, M/2+1 samples of the quadrature data using appropriate quantization methods, such as VQ, split VQ, multi-stage VQ, wavelet VQ, TCQ, or wavelet TCQ quantizers, producing at least one code index and a quantized quadrature vector. Note that quadrature data will be zero for matched-filter methods. Encode Quadrature step 278 can also perform linear or nonlinear downsampling on the inphase vector in order to increase the bandwidth-per-sample.

Following Encode Quadrature step 278, Compute Conjugate Spectrum step 279 uses the quantized inphase vector and quantized quadrature vector to produce the conjugate FFT spectrum, which will be familiar to those of skill in the art. The reconstructed inphase and quadrature vectors are then used in Inverse FFT step 280 to produce a quantized, energy-normalized, cyclically-shifted target vector. Next, Inverse Cyclic Transform step 281 performs an inverse cyclic shift to return the vector to its original position.

A determination is then made, in step 282, whether Target Period>M. If not, the procedure ends. If so, Upsample step 283 upsamples the target vector to the original vector length using methods well known to those of skill in the art, producing a quantized, energy-normalized target vector. The procedure then ends.

While a preferred embodiment of Target Encoding Means 270 encodes inphase and quadrature vectors, alternate embodiments could also be appropriate, such as magnitude and phase representations. Target Encoding Means 270 can be used in conjunction with the ensemble mean, ensemble filter, and matched filter methods discussed above.

Referring again to FIG. 1, Target Encoding Means 270 is followed by Error Component Computation Means 310. A preferred embodiment of the present invention implements an ensemble source-to-target interpolation process at the receiver in order to reconstruct an estimate of elided excitation components. In addition to the interpolation model, a preferred embodiment of the invention extracts and encodes one or more error components.

Error components represent those excitation components that are not modeled by source-to-target ensemble interpolation. Hence, the interpolated waveform and modeling error waveform produce periodic and pseudo-random functions, respectively, which correspond directly to the current analysis segment and spectral model. In this manner, the ensemble interpolation operation results in an effective low-pass type of process. At the receiver, by combining a representation of the interpolation error and one or more of the remaining orthogonal error components with the interpolated model natural-sounding, high-quality speech can be achieved.

Inclusion of all error components results in an identity system, where output speech matches input speech. In order to recover some of the waveform characteristics lost in the spectrum and prototype quantization process, a closed-loop approach is incorporated in a preferred embodiment of the present invention, although an open loop process could also be appropriate. In this manner, the error waveforms are derived from a quantized excitation model. Hence, quantization error will be taken into account along with the overall ensemble interpolation error, or modeling error. Quantization of the error component requires a staged process, whereby quantized spectrum is used to generate an excitation waveform and subsequent prototype quantized, and quantized prototypes are subsequently used to develop quantizers for the error waveforms. In addition to improving the interpolation model, proper quantization of the error waveform will recover at least some of the characteristics lost in quantization of the spectrum and prototype.

Figure 18:
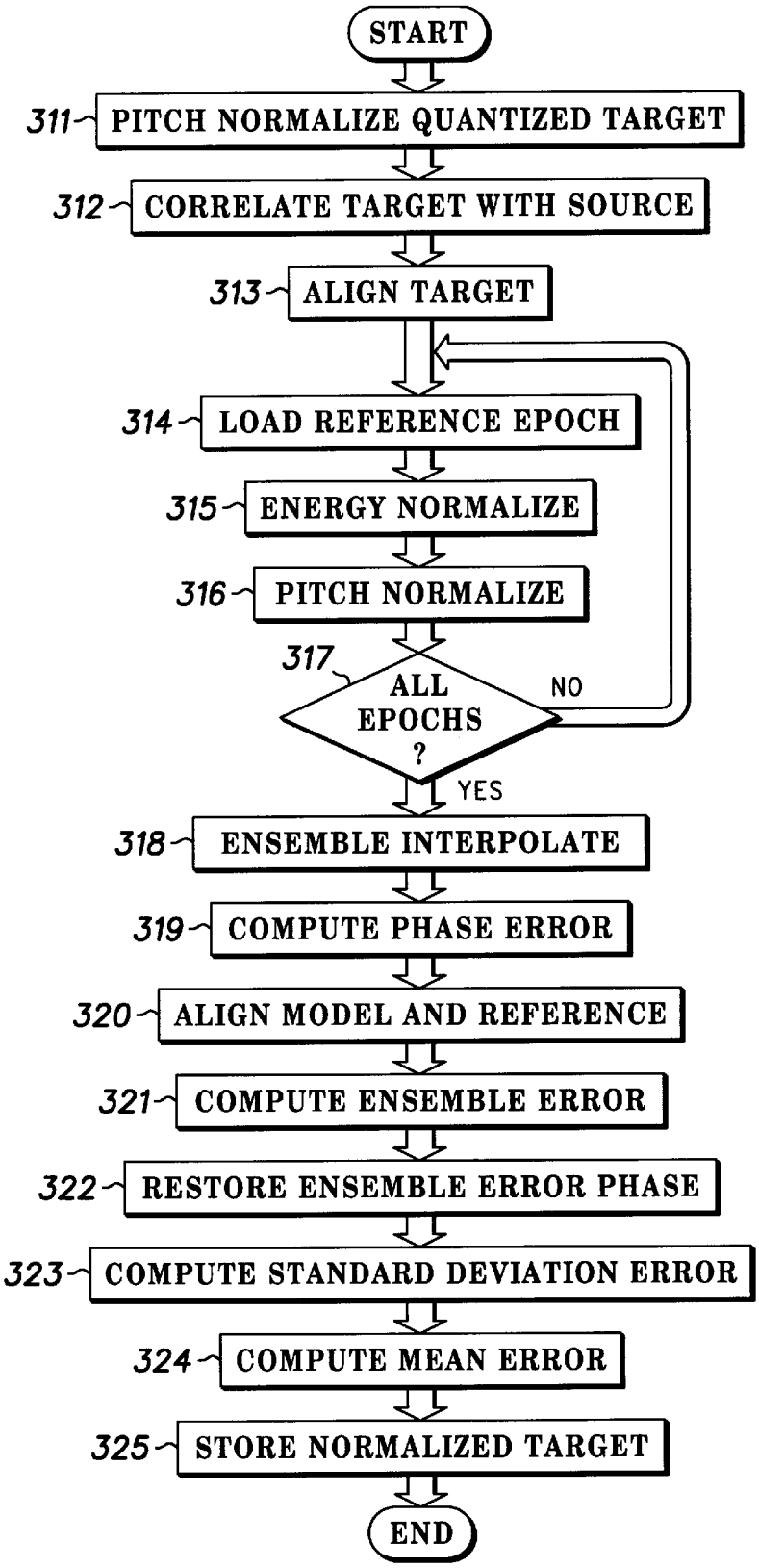
FIG. 18 illustrates a method for computation of orthogonal error components in accordance with a preferred embodiment of the present invention.

FIG. 18 illustrates a method for computation of orthogonal error components in accordance with a preferred embodiment of the present invention which is performed by Error Component Computation Means 310. Orthogonal error components, in a preferred embodiment, include phase error (step 319), ensemble error (step 321), standard deviation error (step 323), and mean error (step 324). These error components which are intrinsically orthogonal (i.e., uncorrellated) are represented as waveforms because they depict errors over a segment of speech samples or a period of time. The method can be said to orthogonalize the error components because specific components which are intrinsically uncorrellated are computed. The method begins with Pitch Normalize Quantized Target step 311. Although the effective "local" pitch length (i.e., the pitch for the current frame) is already normalized to within one sample from Rx Epoch Locations Estimation Means 180, Pitch Normalize Quantized Target step 311 can upsample or downsample the segment to a second "global" normalizing length (i.e., a common pitch length for all frames), producing a unit variance, zero mean target vector with a normalized length. Upsampling of segments to an arbitrarily large value in this fashion has proven to be of value in epoch-to-epoch alignment and error computation, although downsampling to a smaller length could also be of value.

After Pitch Normalize Quantized Target step 311, the normalized target is correlated against the normalized target from the previous frame, or the "source", which was stored to memory in an earlier operation. Correlate Target with Source step 312 hence produces an optimal alignment offset which is used by Align Target step 313 to cyclically shift the target epoch in order to maximize ensemble correlation, producing a quantized, normalized, shifted target.

After alignment of the target, the reference excitation waveform is computed an placed in a temporary buffer. The first reference epoch, computed by Excitation Computation Means 160, is loaded into the buffer in Load Reference Epoch step 314. Next, Energy Normalize step 315 computes the mean and standard deviation of the reference epoch, and normalizes the reference epoch by subtracting the mean and dividing by the standard deviation for each epoch sample, producing a unit-variance, zero-mean reference epoch. Energy Normalize step 315 also stores the standard deviation and mean value for the current epoch to a second and third reference sequence, respectively, for later use. Next, Pitch Normalize step 316 length normalizes the reference epoch in a manner identical with the method of Pitch Normalize Quantized Target step 311, producing an energy normalized, length normalized reference epoch.

A determination is made, in step 317, whether all reference epochs have been computed. If not, the procedure iterates as shown in FIG. 18, where the next contiguous epoch segment is energy normalized, length normalized, and reference epochs have been placed in the buffer. If all reference epochs have been computed, Ensemble Interpolate step 318 produces an ensemble interpolated excitation waveform (i.e., the interpolation model) by ensemble point-to-point interpolation from the source to the shifted target, producing intervening epochs corresponding to the number of epochs in the analysis segment, minus one (i.e., the target).

Next, Compute Phase Error step 319 computes the alignment offset for each epoch in the reference buffer relative to each epoch in the interpolation model, producing a sequence of integer offset values. In a preferred embodiment, Compute Phase Error step 319 uses correlation to compute the optimal offset for each reference epoch, although any method could be used which aligns the reference and model to minimize epoch-to-epoch distance.

Align Model and Reference step 320 then cyclically shifts each epoch in the reference by the respective optimal offset in order to optimally align the reference and interpolation model prior to error computation, producing an aligned excitation reference. For each epoch in the interpolation model, Compute Ensemble Error step 321 then subtracts the aligned excitation reference epoch on a point-to-point basis, producing a sequence of values representing the ensemble model error, or ensemble interpolation error for the segment of excitation being modeled. Following Compute Ensemble Error step 321, Restore Ensemble Error Phase step 322 cyclically shifts each epoch-synchronous error segment in the error waveform to it's pre-aligned, unshifted state for later characterization and encoding.

Compute Standard Deviation Error step 323 then computes a model of standard deviation behavior across the segment of elided standard deviation values, and subtracts the model from the second reference sequence to produce a standard deviation error sequence. Alternatively, the model and reference could be used to form a fractional error factor. In a preferred embodiment, a linear interpolation model is used, whereby the source standard deviation is interpolated linearly to the standard deviation of the target, producing interpolated values of standard deviation for each elided epoch in the frame. Other non-linear standard deviation models could also be appropriate. In order to maintain fractional error to reasonable values, a preferred embodiment employs an absolute minimum limit that the interpolated standard deviation is allowed to achieve.

Similarly, Compute Mean Error step 324 then linearly interpolates from the source mean to the target mean, producing interpolated values of mean for each elided epoch in the frame, and subtracts the model from the third reference sequence to produce a mean error sequence. As with the standard deviation error, an alternate embodiment could use the model and reference to compute a fraction error factor. Again, in order to maintain fractional error to reasonable values, a preferred embodiment employs an absolute minimum limit that the interpolated mean value is allowed to achieve.

Next, Store Normalized Target step 325 stores the quantized, energy-normalized, pitch-normalized target to memory, along with the quantized mean and quantized standard deviation, effectively producing the source target, source mean, and source standard deviation. The procedure then ends.

Figure 19:
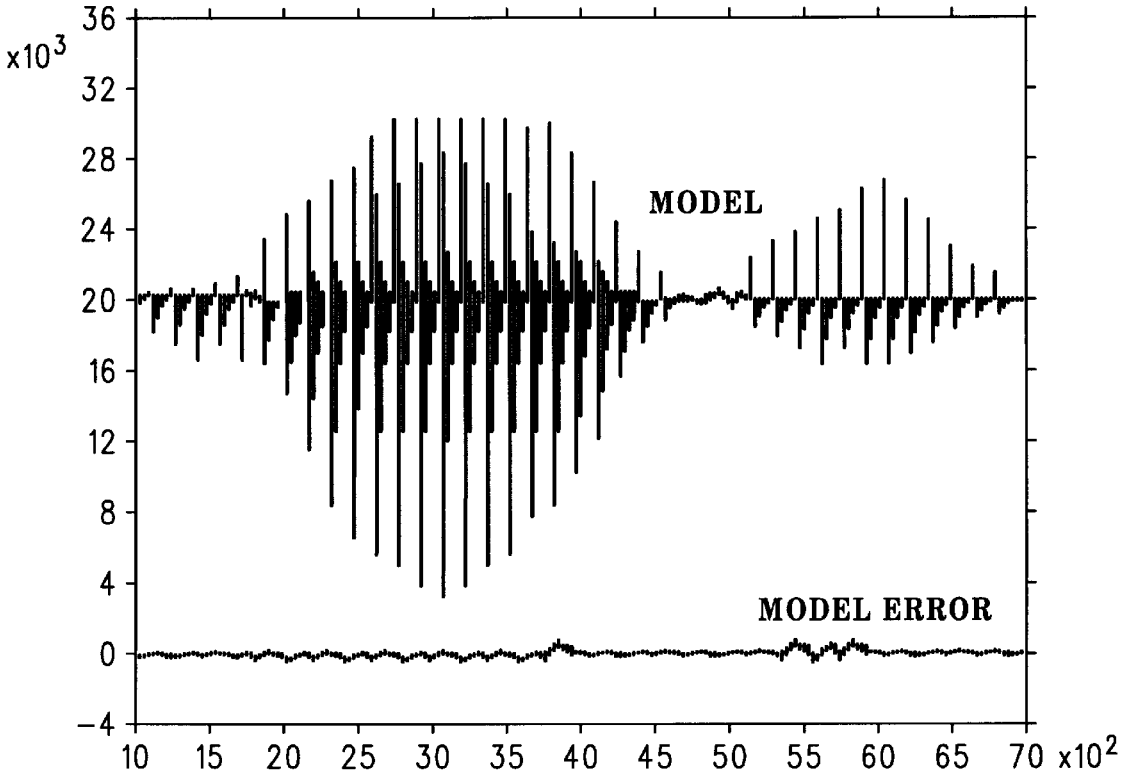
FIG. 19 illustrates a typical length-normalized, energy-denormalized periodic model derived from the ensemble-mean target, and a typical ensemble error waveform in accordance with a preferred embodiment of the present invention.
Figure 22:
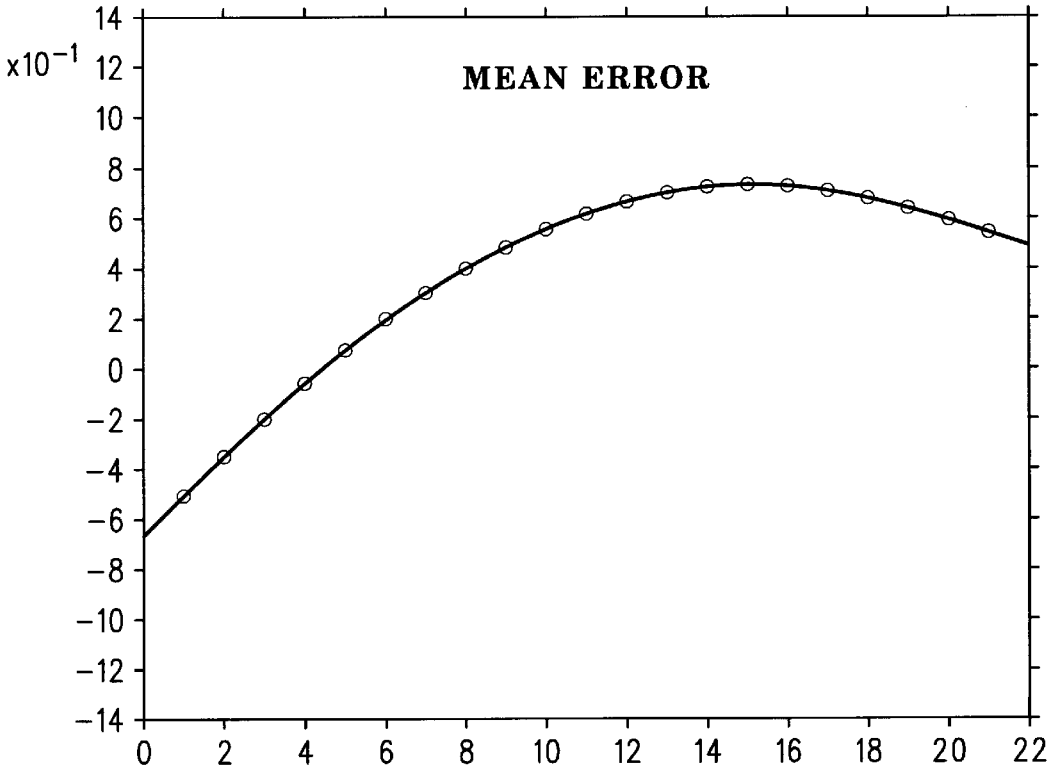
FIG. 22 illustrates a typical mean error waveform derived in accordance with a preferred embodiment of the present invention.
Figure 23:
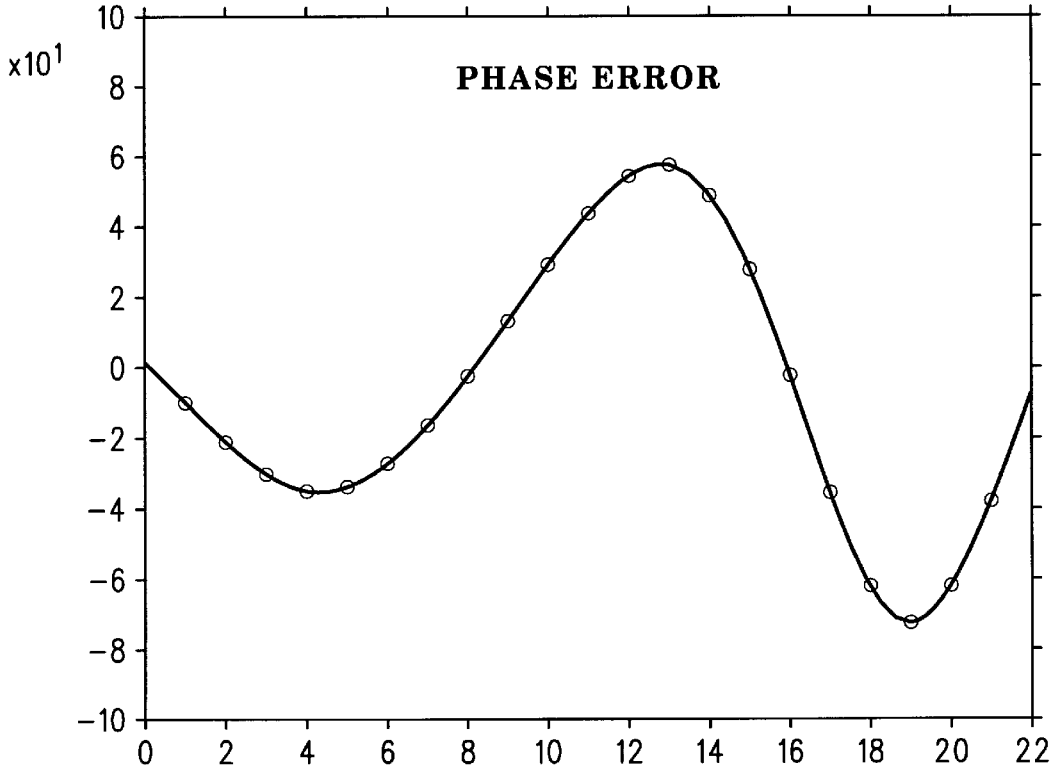
FIG. 23 illustrates a typical phase error waveform derived in accordance with a preferred embodiment of the present invention.

FIG. 19 illustrates a typical length-normalized, energy-denormalized periodic model derived from the ensemble-mean target, and a typical ensemble error waveform in accordance with a preferred embodiment of the present invention. FIG. 20 illustrates a typical periodic model derived from the match-filtered target, and the typical ensemble error waveform derived from the match-filtered reference in accordance with a preferred embodiment of the present invention. FIG. 21 illustrates a typical standard deviation error waveform derived in accordance with a preferred embodiment of the present invention, expressed in fractional units relative to the standard deviation interpolative model, although other units could also be appropriate. FIG. 22 illustrates a typical mean error waveform derived in accordance with a preferred embodiment of the present invention, expressed in fractional units relative to the interpolative mean model, although other units could also be appropriate. FIG. 23 illustrates a typical phase error waveform derived in accordance with a preferred embodiment of the present invention, with each value expressed as an absolute offset, although other units could also be appropriate.

Error Component Computation Means 310 can be used in conjunction with the ensemble mean, ensemble filter, and matched filter methods discussed above.

Referring again to FIG. 1, following Error Component Computation Means 310, Ensemble Error Encoding Means 350 characterizes the error sequence and encodes it for transmission or storage. Characterization and encoding of the ensemble error component can include baseband I and Q representations, although other representations could also be appropriate. In one embodiment of the invention, error component characterization includes lowpass filtering of the normalized error component prior to excitation reconstruction and speech synthesis. Filter cutoffs on the order of 0.1 bandwidth (BW) or less can be imposed upon the normalized, length-expanded error components, resulting in a significant reduction in high-frequency energy.

Notably, when properly performed, this pre-filtering operation introduces little, if any, perceptual distortion for both male and female speakers upon reconstruction of the speech waveform, indicating that the error component need not be accurately represented at low bit rates.

In addition to direct error component characterization, an alternate embodiment uses a form of indirect characterization via spectral modeling of the error waveform. In this manner, a multi-pole LPC analysis and inverse filter is used to generate parameters describing the error waveform spectral envelope and corresponding "excitation", each of which can be encoded separately.

Figure 24:
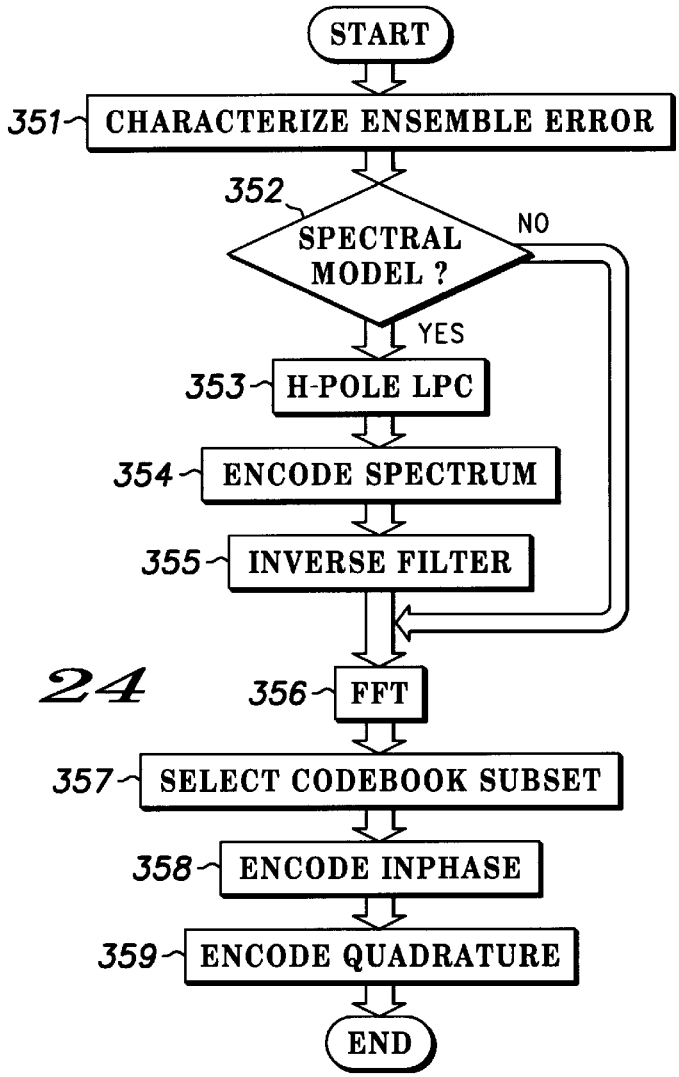
FIG. 24 illustrates a method for encoding the ensemble modeling error in accordance with a preferred embodiment of the present invention.

FIG. 24 illustrates a method for encoding the ensemble modeling error in accordance with a preferred embodiment of the present invention and performed by Ensemble Error Encoding Means 350. The method begins with Characterize Ensemble Error step 351, wherein the length and energy normalized error waveform is first lowpass filtered, producing a lowpass-filtered ensemble error waveform. By characterizing the ensemble error waveform in the pitch-normalized domain, a harmonic-aligned, fixed length vector is produced which is ideal for quantization.

Figure 25:
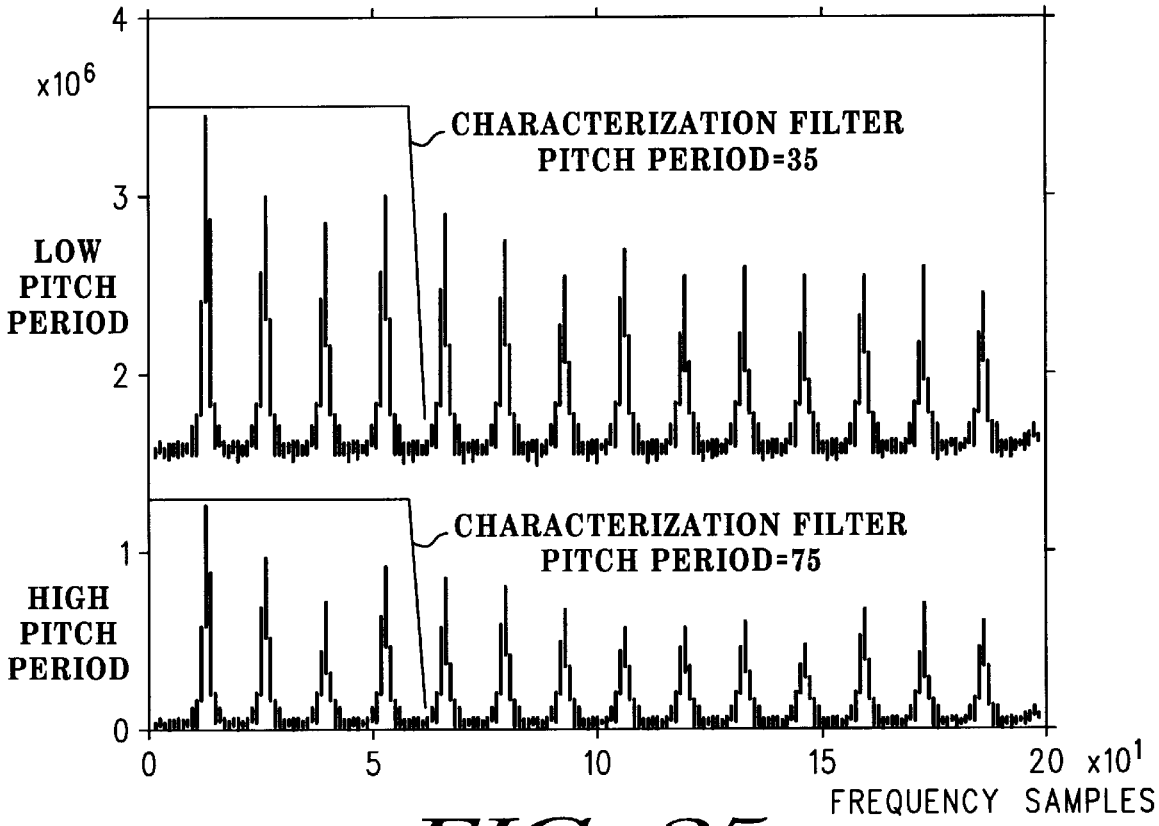
FIG. 25 illustrates ensemble error characterization filtering of pitch normalized data derived in accordance with a preferred embodiment of the present invention.

To illustrate, FIG. 25 shows ensemble error characterization filtering of pitch normalized data derived in accordance with a preferred embodiment of the present invention (i.e., the magnitude spectrum of two normalized representative periodic waveforms with different pitch). The typical error waveform spectrum is much less periodic. However, a latent periodic component can often be present since the error component is derived on a length-normalized epoch synchronous basis. In the frequency domain, the harmonics of the length-normalized waveforms are automatically aligned with each other, simplifying quantization of the baseband representation. By lowpass filtering the normalized data (as shown in FIG. 25), quantization could be performed on harmonic-aligned, fixed-length vectors, (i.e., inphase and quadrature) notably improving quantization performance and subsequent speech quality. In a preferred embodiment of the invention, an effective error characterization filter has been experimentally shown to require approximately 64 frequency domain samples in order to preserve speech quality, corresponding to four harmonics of the error waveform, although more or fewer samples could also be appropriate. Note that a larger vector length preserves more harmonics of the error waveform.

Following Characterize Ensemble Error step 351, a determination is made, in step 352, whether a spectral model method is to be employed. Given the preservation of four harmonics using the characterization filter illustrated in FIG. 25, a four pole spectral error model (H=4) is especially well-suited for representation of the error waveform.

Figure 26:
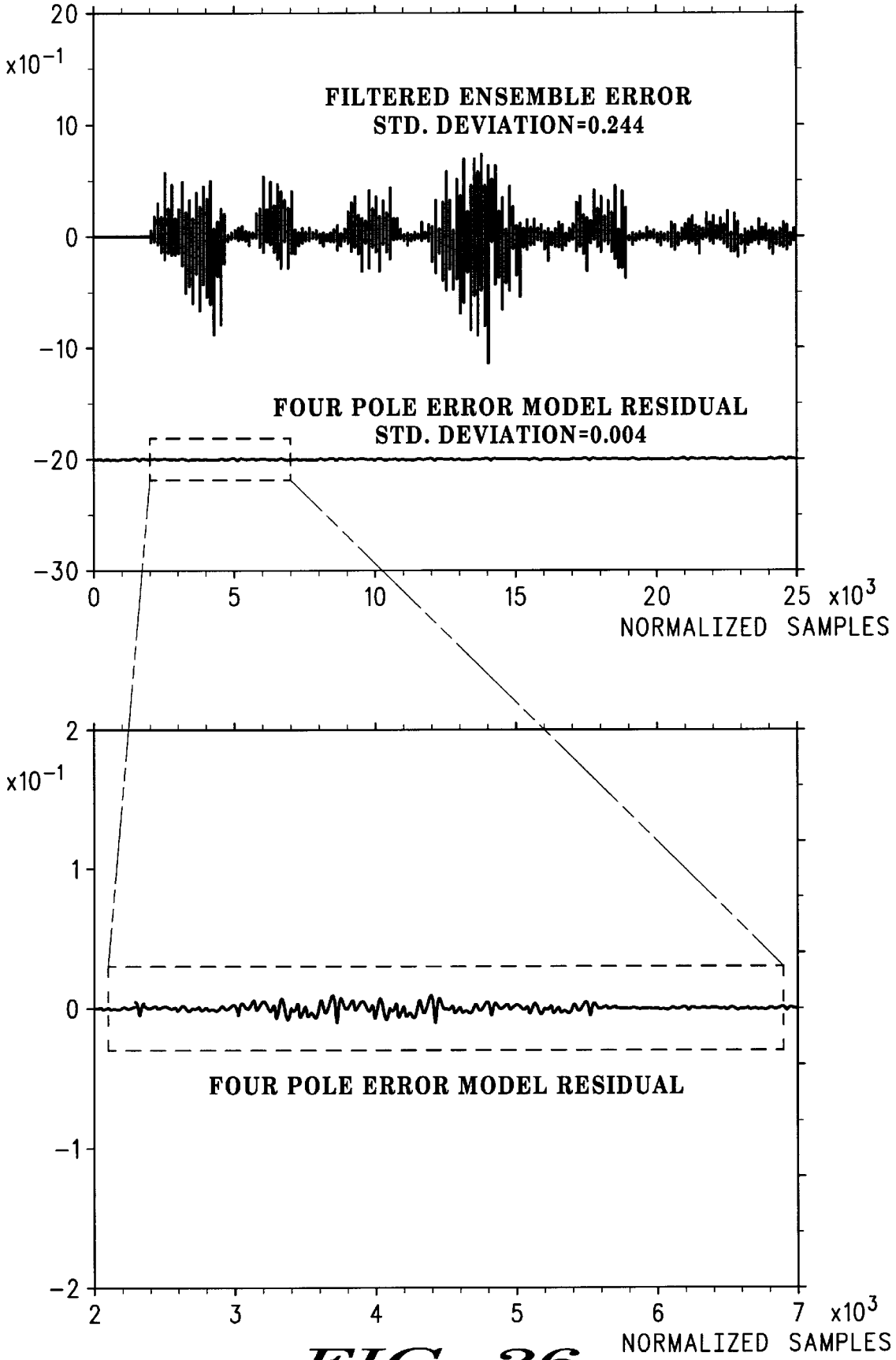
FIG. 26 illustrates ensemble error characterization using a spectral model derived in accordance with a preferred embodiment of the present invention.

To illustrate, FIG. 26 shows ensemble error characterization using a spectral model derived in accordance with a preferred embodiment of the present invention (i.e., the lowpass filtered error waveform, and the four-pole error model residual of the error waveform). Note a sigma reduction from 0.244 in the filtered waveform to 0.004 in the four-pole residual, which represents a drop of over 35 dB. A bandwidth versus speech quality tradeoff optimizes the bandwidth allocated to the four pole model and the corresponding residual.

If step 352 determines that a spectral model method is to be employed, H-Pole LPC step 353 performs an LPC analysis on the characterized error waveform, producing spectral error model parameters. Encode Spectrum step 354 then encodes the spectral parameters using quantization methods such as VQ, split VQ, multi-stage VQ, wavelet VQ, TCQ, and wavelet TCQ implementations. In a preferred embodiment, Encode Spectrum step 354 encodes H line spectral frequencies using a multi-stage vector quantizer, producing at least one code index and quantized spectral error model parameters, although other coding methods are also appropriate. The quantized error model parameters and characterized ensemble error are used to generate a spectral error model excitation waveform in Inverse Filter step 355 using methods well known to those of skill in the art.

Following Inverse Filter 355 (or if step 352 determined that no spectral model method is to be employed), the spectral error model excitation (or the characterized ensemble error) is transformed by FFT step 356, which produces an inphase and quadrature waveform. Select Codebook Subset step 357 uses the degree-of-periodicity computed by Degree of Periodicity Calculation Means 30 to select the codebook set which corresponds to the identified class for the speech segment under analysis.

Encode Inphase step 358 then encodes the inphase component computed by FFT step 356 using the codebook subset identified by Select Codebook Subset step 357. Encode Inphase step 358 encodes the inphase data using quantization methods such as VQ, split VQ, multi-stage VQ, wavelet VQ, TCQ, and wavelet TCQ implementations, producing one or more code indices. Encode Quadrature step 359 then encodes the quadrature component computed by FFT step 356 using the codebook subset identified by Select Codebook Subset step 357. Encode Quadrature step 359 encodes the quadrature data using quantization methods such as VQ, split VQ, multi-stage VQ, TCQ, and wavelet TCQ implementations, producing one or more code indices. While a preferred embodiment of Ensemble Error Encoding Means 350 encodes inphase and quadrature vectors, alternate embodiments could also be appropriate, such as magnitude and phase representations.

Referring again to FIG. 1, Ensemble Error Encoding Means 350 is followed by Standard Deviation Error Encoding Means 390, Mean Error Encoding Means 420, and Phase Error Encoding Means 460, each of which produces at least one code index corresponding to the standard deviation error, mean error, and phase error, respectively, computed by Error Component Computation Means 310.

Figure 27:
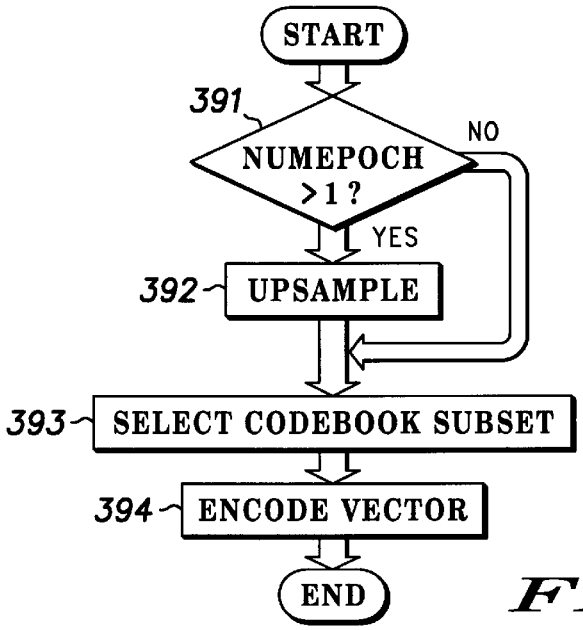
FIG. 27 illustrates a method for encoding standard deviation error, mean error, or phase error in accordance with a preferred embodiment of the present invention.

FIG. 27 illustrates a method for encoding standard deviation error, mean error, or phase error in accordance with a preferred embodiment of the present invention. The method is performed by Standard Deviation Error Encoding Means 390, Mean Error Encoding Means 420, and Phase Error Encoding Means 460. The method begins by determining, in step 391, whether Numepoch>1, where Numepoch corresponds to the number of epochs in the current frame under analysis, as calculated by Tx Epoch Location Estimation Means 110.

If step 391 determines that the number of epochs exceeds one, Upsample step 392 upsamples the error vector to a common vector length. In a preferred embodiment of the invention, Upsample step 392 upsamples the error vector, which initially has Numepoch samples, to a common length equal to the maximum number of epochs allowed per frame (e.g., twelve, although other normalizing lengths could also be appropriate).

After Upsample step 392, or if step 391 determines that the current analysis segment contains only one epoch, Select Codebook Subset step 393 is performed, which uses the degree-of-periodicity computed by Degree of Periodicity Calculation Means 30 to select the codebook set which corresponds to the identified class for the speech segment under analysis. If the number of epochs is equal to one, the codebook subset can also include a scalar quantizer corresponding to the single standard deviation error value, mean error value, or phase error value.

Encode Vector step 394 then encodes the standard deviation error vector, mean error vector, or phase error vector, or scalar values corresponding to those error vectors using quantization methods such as VQ, split VQ, multi-stage VQ, wavelet VQ, TCQ, and wavelet TCQ implementations, producing one or more code indices. The procedure then ends.

Referring again to FIG. 1, Phase Error Encoding Means 460 is followed by Degree of Periodicity Encoding Means 465, which scalar quantizes the degree of periodicity produced by Degree of Periodicity Calculation Means 30, producing a code index.

Degree of Periodicity Encoding Means 465 is followed by Modulation and Channel Interface Means 470, which constructs a modulated bitstream corresponding to the encoded data using methods well known to those of skill in the art. The modulated data bitstream is transmitted via Modulation and Channel Interface Means 470 to Channel 475, where the channel can be any communication medium, including fiber, RF, or coaxial cable, although other media are also appropriate.

Synthesis Processor 900 receives the modulated, transmitted bitstream via Channel 475, and demodulates the data using Channel Interface and Demodulation Means 480 using techniques well known to those of skill in the art, producing code indices corresponding to the code indices generated by Analysis Processor 100.

Channel Interface and Demodulation Means 480 is followed by several decoding steps which utilize code indices produced by Channel Interface and Demodulation Means 480. First, Target Location Decoding Means 485 decodes the target location, producing an integer target location. Frequency Decoding Means 490 then decodes the number of epochs, producing an integer number of epochs. Next, Degree of Periodicity Decoding Means 495 decodes the degree of periodicity, producing a discrete degree of periodicity class. Target Standard Deviation Decoding Means 500 then decodes the target standard deviation, producing a target standard deviation value. In a preferred embodiment, Target Standard Deviation Decoding Means 500 selects from codebooks corresponding to each of the discrete degrees-of-periodicity produced by Degree of Periodicity Decoding Means 495, although a non-class-based approach could also be appropriate.

Target Standard Deviation Decoding Means 500 is followed by Target Mean Decoding Means 505, producing a target mean value. In a preferred embodiment, Target Mean Decoding Means 505 selects from codebooks corresponding to each of the discrete degrees-of-periodicity produced by Degree of Periodicity Decoding Means 495, although a non-class-based approach could also be appropriate.

Decode Target Mean 505 is followed by Standard Deviation Error Decoding Means 510, Mean Error Decoding Means 550, and Phase Error Decoding Means 590. Each of these Decoding Means 510, 550, and 590 perform a similar decoding process. Channel Interface and Demodulation Means 480 produces at least one code index which is decoded by Standard Deviation Error Decoding Means 510, Mean Error Decoding Means 550, and Phase Error Decoding Means 590 to produce a standard deviation error, mean error, and phase error, respectively.

Figure 28:
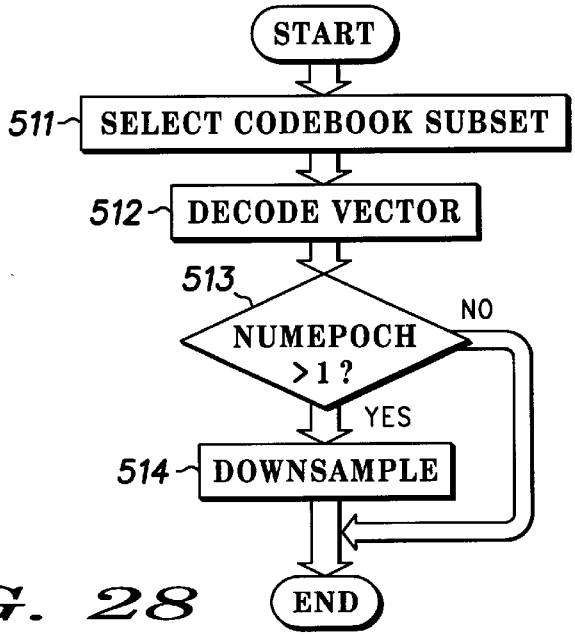
FIG. 28 illustrates a method for decoding standard deviation error, mean error, or phase error in accordance with a preferred embodiment of the present invention.

FIG. 28 illustrates a method for decoding standard deviation error, mean error, and phase error in accordance with a preferred embodiment of the present invention as performed by Standard Deviation Error Decoding Means 510. The method begins with Select Codebook Subset step 511, which uses the degree-of-periodicity produced by Degree of Periodicity Decoding Means 495 to select the codebook set which corresponds to the identified class for the speech segment being synthesized.

Next, Decode Vector step 512 decodes the error vectors or scalar values using the companion codebook subset of Standard Deviation Error Encoding Means 390, Mean Error Encoding Means 420, and Phase Error Encoding Means 460, respectively. In a preferred embodiment, decoding is performed using quantization methods such as VQ, split VQ, multi-stage VQ, wavelet VQ, TCQ, and wavelet TCQ implementations, producing the decoded, length-normalized standard deviation error vector, mean error vector, phase error vector, or scalar values for these errors.

A determination is made, in step 513, whether the number of epochs produced by Frequency Decoding Means 490 exceeds one. If not, the procedure ends. If so, Downsample step 514 is performed, which downsamples each error vector to a number of samples equal to the number of epochs within the frame to be synthesized using methods well known to those of skill in the art, producing downsampled error vectors. The procedure then ends.

Referring again to FIG. 1, Phase Error Decoding Means 590 is followed by Rx Epoch Location Computation Means 630, which uses the decoded target location from Target Location Decoding Means 485, and the decoded number of epochs from Frequency Decoding Means 490, to calculate the synthesized epoch locations, producing a sequence of epoch locations with an effective normalized pitch for each epoch within one sample of the average pitch.

Figure 29:
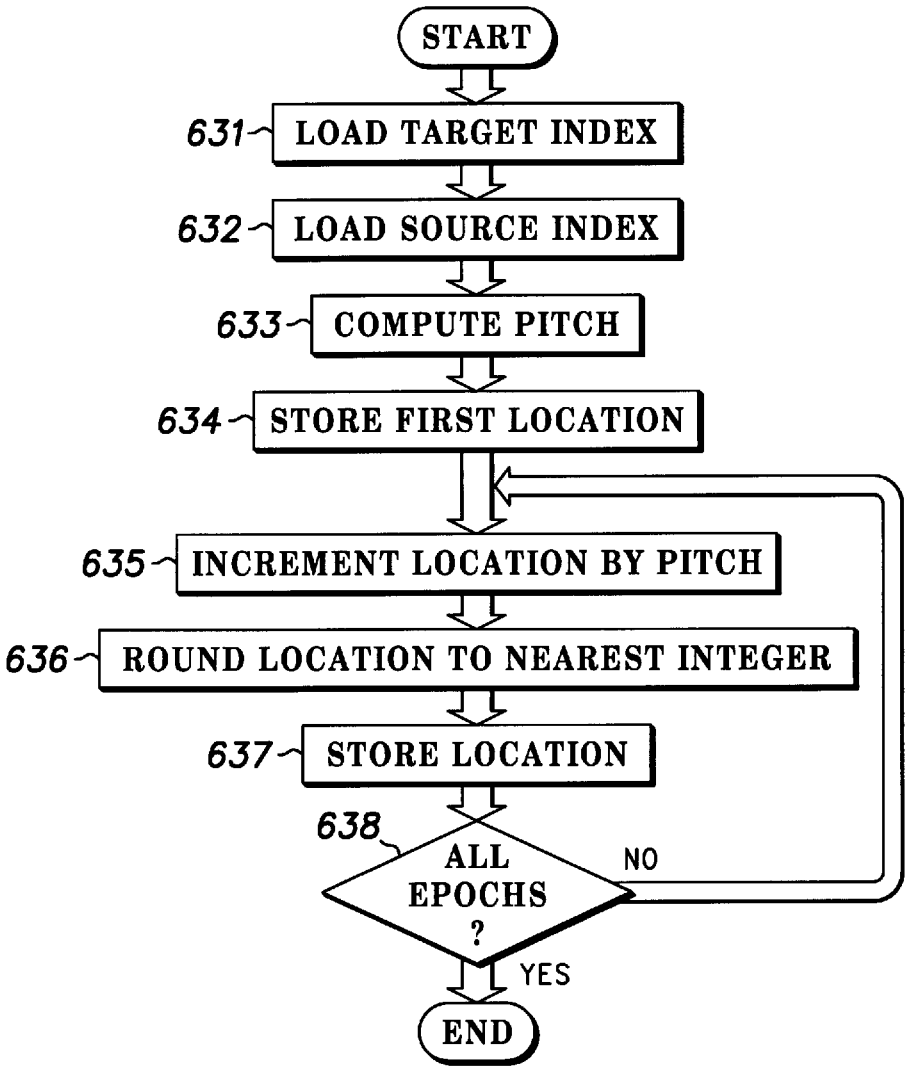
FIG. 29 illustrates a method for computing receiver epoch locations in accordance with a preferred embodiment of the present invention.

FIG. 29 illustrates a method for computing receiver epoch locations in accordance with a preferred embodiment of the present invention as performed by Rx Epoch Location Computation Means 630. The method begins with Load Target Index step 631, which loads from memory the target index, ti, determined by Target Location Decoding Means 485. Load Source Index step 632 loads from memory the previous target index, and subtracts the frame length to form the source index, si.

Compute Pitch step 633 then uses the source index from Load Source Index step 632, the target index from Load Target Index step 631, and the number of epochs, ne, from Frequency Decoding Means 490, and computes the pitch, P, using the relation: P=(ti-si)/ne. Store First Location step 634 sets a location pointer, L, to the first epoch location, corresponding to the source index, si.

Increment Location by Pitch step 635 then increments the location pointer by the pitch estimate, P, forming a next location estimate. The location estimate, L, is rounded to the nearest integer to reflect a proper sample index in Round Location to Nearest Integer step 636. The location index is stored to memory by Store Location step 637. A determination is then made whether all locations have been computed. If not, the procedure iterates as shown in FIG. 29. If all locations have been computed and stored to memory, the procedure ends.

Referring again to FIG. 1, Rx Epoch Location Computation Means 630 is followed by Target Decoding Means 670, which uses the one or more codebook indices produced by Channel Interface and Demodulation Means 480 along with the degree of periodicity class produced by Degree of Periodicity Decoding Means 495, to produce an energy normalized target.

Figure 30:
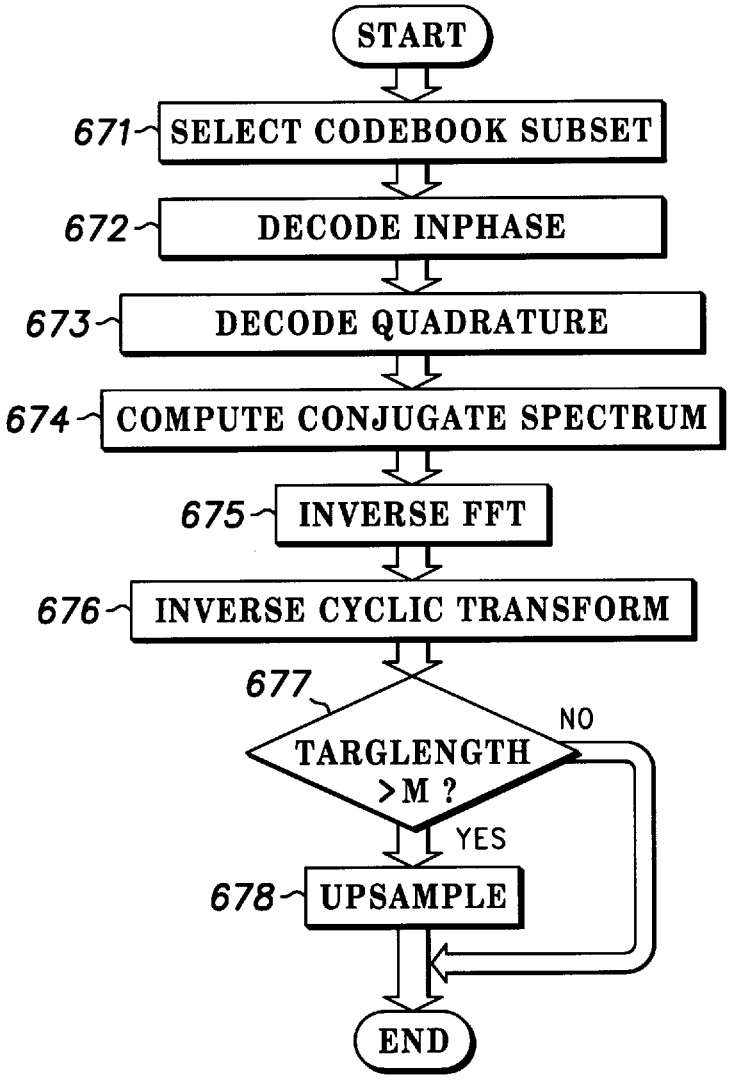
FIG. 30 illustrates a method for decoding target data in accordance with a preferred embodiment of the present invention.

FIG. 30 illustrates a method for decoding target data in accordance with a preferred embodiment of the present invention as performed by Target Decoding Means 670. The method begins with Select Codebook Subset step 671, which uses the degree-of-periodicity produced by Degree of Periodicity Decoding Means 495 to select the codebook set which corresponds to the identified class for the speech segment being synthesized.

Following Select Codebook Subset step 671, Decode Inphase step 672 uses the codebook subset for inphase vectors along with one or more code indices to produce the decoded target inphase vector. Decode Quadrature step 673 then uses the codebook subset for quadrature vectors along with one or more code indices to produce the decoded target quadrature vector. In a preferred embodiment, both steps 672 and 673 use quantization methods such as VQ, split VQ, multi-stage VQ, wavelet VQ, TCQ, and wavelet TCQ methods.

Following Decode Quadrature step 673, Compute Conjugate Spectrum step 674 uses the quantized inphase vector and quantized quadrature vector to produce the conjugate FFT spectrum, which will be familiar to those of skill in the art. Compute Conjugate Spectrum step 674 produces M Inphase samples and M quadrature samples, where M corresponds to the FFT size used by Target Encoding Means 270. Next, Inverse FFT step 675 performs an inverse M-point FFT on the M-point inphase and M-point quadrature vectors to produce the cyclically-shifted, energy-normalized target vector. Inverse Cyclic Transform step 676 then applies the inverse process described in conjunction with Cyclic Transform step 274 (FIG. 18) which was applied by Target Encoding Means 270, producing an energy-normalized target vector in the inphase data array.

A determination is then made, in step 677, whether the actual target length, Targlength, exceeds M samples. If so, Upsample step 678 is performed, which upsamples the M sample target to the desired target length. After Upsample step 678, or if the actual target length does not exceed M samples, the procedure ends.

While a preferred embodiment of Target Decoding Means 670 docodes inphase and quadrature vectors, alternate embodiments could also be appropriate, such as magnitude and phase representations.

Figure 31:
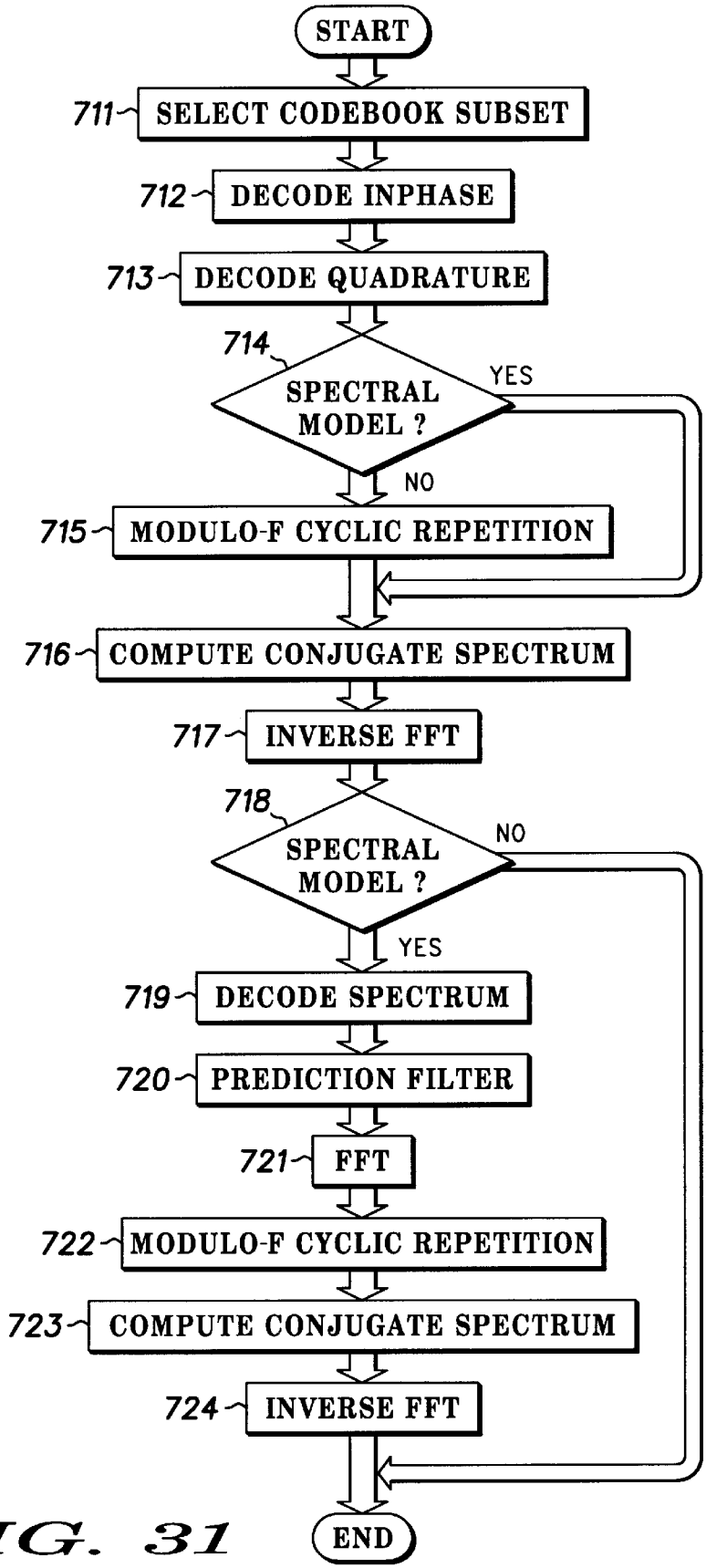
FIG. 31 illustrates a method for decoding ensemble error in accordance with a preferred embodiment of the present invention.

Referring again to FIG. 1, Target Decoding Means 670 is followed by Ensemble Error Decoding Means 710. FIG. 31 illustrates a method for decoding ensemble error in accordance with a preferred embodiment of the present invention as performed by Ensemble Error Decoding Means 710.

The method begins with Select Codebook Subset step 711, which uses the degree-of-periodicity produced by Degree of Periodicity Decoding Means 495 to select the codebook set which corresponds to the identified class for the speech segment being synthesized. Decode Inphase step 712 then uses the codebook subset for inphase error vectors along with one or more code indices to produce the decoded error inphase vector. Decode Quadrature step 713 uses the codebook subset for error quadrature vectors along with one or more code indices to produce the decoded error quadrature vector. In a preferred embodiment, both steps 712 and 713 use quantization methods such as VQ, split VQ, multistage VQ, wavelet VQ, TCQ, and wavelet TCQ methods.

A determination is then made, in step 714 whether an error waveform spectral model is used. If not, Modulo-F Cyclic Repetition step 715 is performed. Lowpass characterization filtering of the ensemble error preserves a relatively high level speech quality and speaker recognition. However, characterization filtering discards the ensemble error waveform's high frequency components, which can contribute to perceived quality. In order to mitigate the effects of lowpass characterization, post-processing methods can be introduced which enhance speech quality without sacrificing bandwidth. In a preferred embodiment of the invention, perceived quality is improved in the face of error waveform filtering by simulating high frequency Inphase and Quadrature components which were discarded at the transmitter. Since Inphase and Quadrature vectors are reconstructed at the receiver, little computation effort is required for such methods. Modulo-F Cyclic Repetition step 715 represents a post-process which ultimately improves synthesized speech quality without the use of additional transmission bandwidth.

Figure 32:
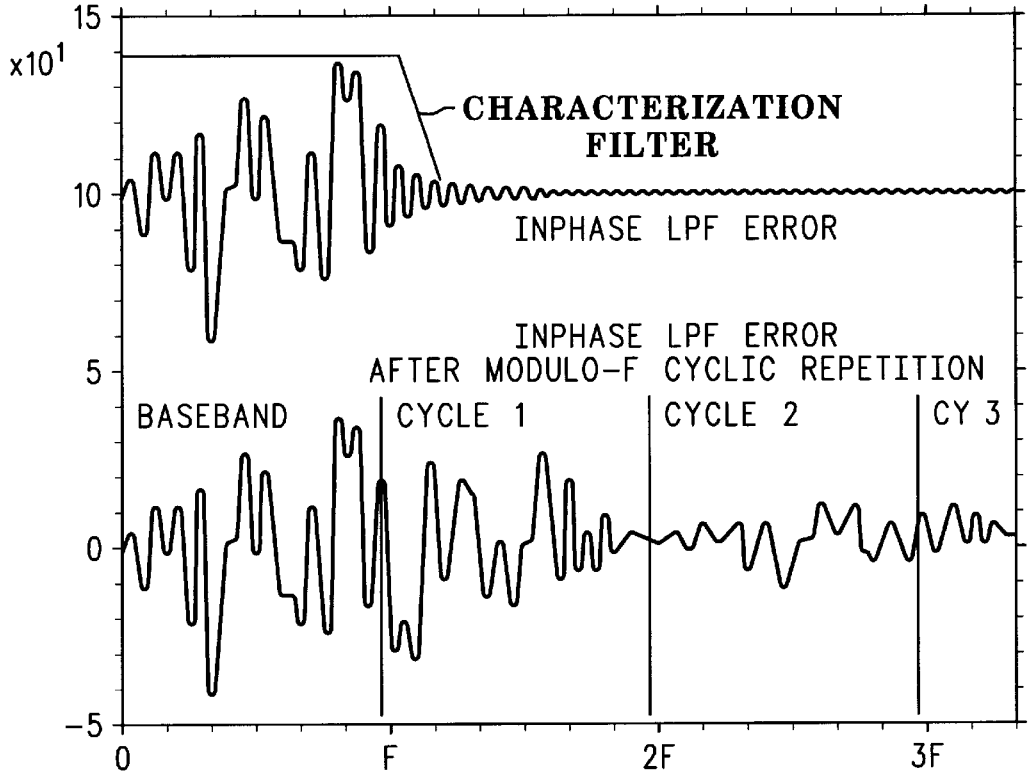
FIG. 32 illustrates error component reconstruction using modulo-F cyclic repetition derived in accordance with a preferred embodiment of the present invention.

FIG. 32 illustrates error component reconstruction using modulo-F cyclic repetition derived in accordance with a preferred embodiment of the present invention as performed by Modulo-F Cyclic Repetition step 715. In this method, the filtered ensemble error is cyclically repeated at modulo-F intervals, where F represents the characterization filter cutoff. In order to preserve waveform phase continuity, sign is changed with each successive cycle. A linear trapezoidal weighting is applied across the synthesized upper frequencies in order to reduce high frequency energy. This technique provides an improvement in quality which is manifest in an apparent "brightening" of the synthesized speech. Quadrature data is modified in the same manner as the inphase data of FIG. 32.

Figure 33:
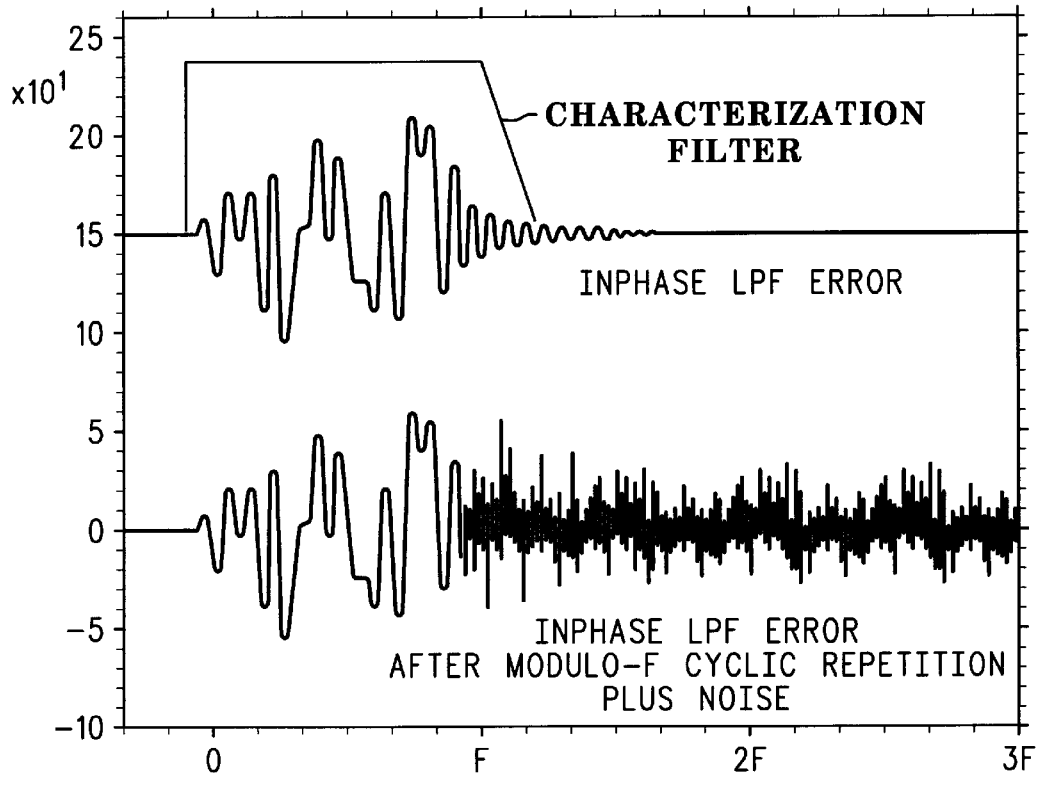
FIG. 33 illustrates error component reconstruction using modulo-F cyclic repetition plus noise derived in accordance with a preferred embodiment of the present invention.

FIG. 33 illustrates error component reconstruction using modulo-F cyclic repetition plus noise derived in accordance with an alternate embodiment of the present invention, which incorporates modulo-F cyclic repetition plus scaled gaussian noise. This technique provides the greatest speech quality improvement for aperiodic speech, determined by the degree-of-periodicity class. Noise power can be proportional to the baseband energy, although other noise power levels could also be appropriate. In one embodiment, the noise power can be proportional to the degree of periodicity class produced by Degree of Periodicity Decoding Means 495. Although this method relies upon classification to perform optimally, classification errors do not significantly impact the synthesized result. Since baseband error information is always preserved, high classification accuracy is not critical to success of the method. Hence, the method can be used with or without degree-of-periodicity class control.

Referring back to FIG. 31, following Modulo-F Cyclic Repetition step 715, or when step 714 determines that an error waveform spectral model is used, Compute Conjugate Spectrum step 716 is performed, which uses the inphase vector and quadrature vector to produce the conjugate FFT spectrum, which will be familiar to those of skill in the art. Compute Conjugate Spectrum step 716 produces the same number of inphase samples and quadrature samples used to transform the ensemble error component by Ensemble Error Encoding Means 350 (FIG. 1).

Next, Inverse FFT step 717 performs an inverse FFT on the inphase and quadrature components, producing a time domain, pitch-normalized ensemble error vector. A determination is made, in step 718 whether the error waveform spectral model embodiment is used. If not, the procedure ends.

In an alternate embodiment of the invention (not shown), where step 718 determines that an error waveform spectral model is used, the procedure would branch to Compute Conjugate Spectrum step. In this embodiment, Compute Conjugate Spectrum step 716 and Inverse FFT step 717 are computed as described above, producing the spectral error model excitation waveform.

In a preferred embodiment, when step 718 determines that an error waveform spectral model is used, Decode Spectrum step 719 is performed, which decodes the spectral error model parameters using companion codebooks to those implemented in conjunction with Encode Spectrum step 354 (FIG. 20) of Ensemble Error Encoding Means 350. Prediction Filter step 720 then uses the spectral error model parameters produced by Decode Spectrum step 719 and the spectral error model excitation waveform produced by Inverse FFT step 717 to produce the ensemble error waveform, using prediction filter methods well known to those of skill in the art.

Following Prediction Filter step 720, FFT step 721 transforms the ensemble error model to produce error waveform inphase and quadrature components. These inphase and quadrature components art used by Modulo-F Cyclic Repetition step 722 to produce inphase and quadrature waveforms with high-band components in the same manner as Modulo-F Cyclic Repetition step 715 described above. Similarly, Compute Conjugate Spectrum step 723 computes the negative spectral components in the same manner as Compute Conjugate Spectrum step 716 discussed above, producing modified inphase and quadrature components.

Inverse FFT step 724 then performs an inverse FFT upon the modified inphase and quadrature components, producing a time domain, pitch-normalized ensemble error vector. While a preferred embodiment of Ensemble Error Decoding Means 710 decodes inphase and quadrature vectors, alternate embodiments could also be appropriate, such as magnitude and phase representations.

Referring again to FIG. 1, Ensemble Error Decoding Means 710 is followed by Spectrum Decoding Means 750, which uses the one or more code indices produced by Channel Interface and Demodulation Means 480 and the companion codebooks to Spectrum Encoding Means 155 to produce quantized spectral parameters. In a preferred embodiment of the invention, Spectrum Decoding Means 750 selects from codebooks corresponding to each of the discrete degrees-of-periodicity produced by Degree of Periodicity Decoding Means 495, although a non-class-based approach could also be appropriate.

Spectrum Decoding Means 750 is followed by Excitation Estimate Computation Means 760, which uses the decoded excitation model and model error components to produce a complete excitation estimate for the speech segment being synthesized.

Figure 34:
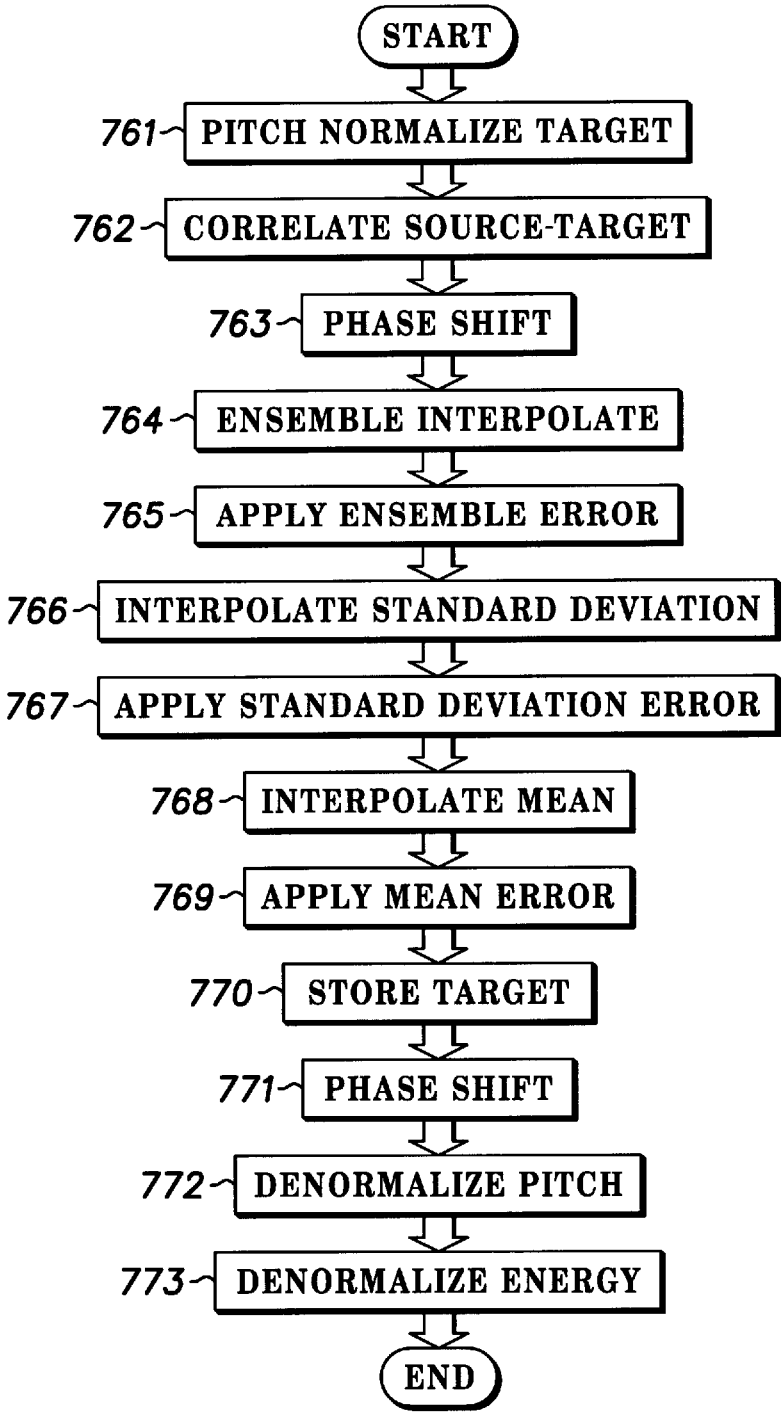
FIG. 34 illustrates a method for computing an excitation estimate in accordance with a preferred embodiment of the present invention.

FIG. 34 illustrates a method for computing an excitation estimate in accordance with a preferred embodiment of the present invention as performed by Excitation Estimate Computation Means 760. The method begins with Pitch Normalize Target step 761. Although the effective "local" pitch length (i.e., the pitch for the current frame) is already normalized to within one sample from Rx Epoch Location Computation Means 630 (FIG. 1), Pitch Normalize Target step 761 can upsample or downsample the segment to a second "global" normalizing length (i.e., a common pitch length for all frames), producing a unit variance, zero mean target vector with a normalized length. Upsampling of segments to an arbitrarily large value in this fashion has proven to be of value in epoch-to-epoch alignment and error computation, although downsampling to a smaller length could also be of value.

After Pitch Normalize Target step 761, the normalized target is correlated against the normalized target from the previous frame, or the "source", which was stored to memory in an earlier operation. Correlate Source-Target step 762 hence produces an optimal alignment offset and cyclically shifts the target epoch in order to maximize ensemble correlation, producing a quantized, normalized, shifted target.

Next, Phase Shift step 763 cyclically shifts each epoch in the ensemble error waveform produced by Ensemble Error Decoding Means 710 (FIG. 1), by the respective optimal offset produced by Phase Error Decoding Means 590 (FIG. 1), in order to align the epoch synchronous error components and interpolation model, producing an aligned ensemble error waveform. Ensemble Interpolate step 764 then produces an ensemble interpolated excitation waveform (i.e., the interpolation model) by ensemble point-to-point interpolation from the source to the shifted target, producing intervening epochs corresponding to the number of epochs in the analysis segment, minus one (i.e., the target).

Following Ensemble Interpolate step 764, Apply Ensemble Error step 765 adds the aligned ensemble error waveform to the ensemble interpolated waveform to produce a pitch-normalized, energy-normalized, shifted excitation waveform. Interpolate Standard Deviation step 766 then computes a standard deviation model for the speech segment to be synthesized. In a preferred embodiment, a linear interpolation model is used, whereby the source standard deviation, stored in an earlier operation, is interpolated linearly to the standard deviation of the target, produced by Target Standard Deviation Decoding Means 500 (FIG. 1), producing interpolated values of standard deviation for each elided epoch in the frame. Other non-linear standard deviation models could also be appropriate.

Next, Apply Standard Deviation Error step 767 combines the standard deviation model with the decoded standard deviation error produced by Standard Deviation Error Decoding Means 510 (FIG. 1), producing an epoch-synchronous standard deviation estimate. Standard deviation error can be applied in either an additive fashion or multiplicative fashion, depending on the method implemented by Error Component Computation Means 310 (FIG. 1). Similarly, Interpolate Mean step 768 computes a mean model for the speech segment to be synthesized. In a preferred embodiment, a linear interpolation model is used, whereby the source mean, stored in an earlier operation, is interpolated linearly to the mean of the target, produced by Target Mean Decoding Means 505 (FIG. 1), producing interpolated values of mean for each elided epoch in the frame. Other non-linear standard deviation models could also be appropriate.

Apply Mean Error step 769 is then performed, which combines the mean model with the decoded mean error produced by Mean Error Decoding Means 550, producing an epoch-synchronous mean estimate. Mean error could be applied in either an additive fashion or multiplicative fashion, depending on the method implemented by Error Component Computation Means 310 (FIG. 1).

Next, Store Target step 770 stores the target epoch to memory, first shifting it to the original target position, effectively producing the "source" epoch for later use. Store Target step 770 also stores the target mean and standard deviation to memory, effectively forming the "source" mean and "source" standard deviation. Phase Shift step 771 then cyclically shifts each epoch-synchronous excitation segment to it's pre-aligned, unshifted state prior to speech synthesis, using the inverse phase operation to that employed by the earlier-described Phase Shift step 763, producing an energy-normalized, pitch-normalized excitation waveform.

Next, Denormalize Pitch step 772 epoch-synchronously downsamples each epoch in the energy-normalized, pitch-normalized excitation waveform to the epoch lengths defined by Rx Epoch Location Computation Means 630 (FIG. 1), producing an energy-normalized excitation waveform. Denormalize Energy step 773 then multiplies each epoch by the epoch-synchronous standard deviation estimate produced by Apply Standard Deviation Error step 767, and adds the epoch-synchronous mean estimate produced by Apply Mean Error step 769 to produce an excitation estimate. The procedure then ends.

In addition to the embodiment of Excitation Estimate Computation Means 760 described above, an alternate embodiment can also include computation of the excitation estimate using a standard-deviation-normalized model and corresponding error waveforms.

Referring again to FIG. 1, following Excitation Estimate Computation Means 760, Speech Synthesis Means 800 uses the excitation estimate to reconstruct high-quality speech. For example, Speech Synthesis Means 800 can consist of direct form or lattice synthesis filters which implement the reconstructed excitation waveform and LPC prediction coefficients or reflection coefficients.

Post Processing Means 810 consists of signal post processing methods well known to those of skill in the art, including adaptive post filtering techniques and spectral tilt re-introduction. Reconstructed, post-processed digitally-sampled speech from Post Processing Means 810 can then be converted to an analog signal via D/A Converter 811 and output to Audio Output Device 901, producing output speech audio. Alternatively, the digital signal or analog signal can be stored to an appropriate storage medium.

In summary, the method and apparatus of the present invention provides an identity-system capability which is ideal for application toward variable rate implementations. Given enough bandwidth, the invention achieves transparent speech output. As such, variable rate embodiments can be developed from a preferred embodiment via a simple change of codebooks. In this fashion, the same algorithm is used across multiple data rates.

A variable-rate implementation of the invention simplifies hardware and software requirements in systems that require multiple data rates, improves performance in environments with widely varying interference conditions, and provides for improved bandwidth utilization in multi-channel applications. In a variable rate embodiment, VQ, split VQ, wavelet VQ, TCQ, wavelet TCQ, or multi-stage VQ codebooks can be developed with varying bit allocations at each desired level of bandwidth.

In one embodiment multi-stage vector quantizers can be developed which incorporate multiple stages that correspond to higher levels of bandwidth. In this manner, low-level stages can be omitted at low bit rates, with a corresponding drop in speech quality. Higher bit rate implementations would use more of the multi-stage VQ stages to achieve higher speech quality. Hence, multi-stage VQ implementations would provide for rapid change in data rate.

At high bit rates, the variable rate vocoder should achieve near transparent speech quality by full application of codebooks of all modeled parameters. At low bit rates, codebook allocations can be reduced, or specific non-critical parameters can be discarded to meet system bandwidth requirements. In this manner, the bandwidth formerly allocated to those parameters can be used for other purposes. In one embodiment, the invention can be used to open multiple channels in a fixed bandwidth by reducing the bandwidth allocated to each channel. The multi-rate embodiment would also be useful in high interference environments, whereby more channel bandwidth is allocated toward FEC in order to preserve intelligibility.

The present invention has been described above with reference to preferred embodiments. However, those skilled in the art will recognize that changes and modifications may be made in these preferred embodiments without departing from the scope of the present invention. For example, the processes and stages identified herein may be categorized and organized differently than described herein while achieving equivalent results. These and other changes and modifications which are obvious to those skilled in the art are intended to be included within the scope of the present invention.

What is claimed is:

1. A method for encoding speech comprising the steps of:

a) generating an excitation waveform by performing a linear prediction coding (LPC) analysis on a number of samples of input speech and inverse filtering the samples of input speech;

b) selecting a source segment of the excitation waveform;

c) computing a target segment as a representative portion of the excitation waveform, wherein the target segment represents a fundamental period of the excitation waveform;

d) computing orthogonal error waveforms by computing at least one model, at least one model reference, and comparing the at least one model reference and the at least one model;

e) encoding the orthogonal error waveforms and parameters describing the input speech; and f) creating a bitstream which includes encoded versions of the orthogonal error waveforms and the parameters.

2. The method as claimed in claim 1, wherein step b) comprises the step of:

b1) selecting the source segment as a prior target segment.

3. The method as claimed in claim 1, wherein step c) comprises the steps of:

c1) selecting a first target as a first portion of the excitation waveform;

c2) correlating the first target with a previous target which is an adjacent portion of the excitation waveform, resulting in an array of correlation coefficients;

c3) aligning the first target segment with the previous target segment by shifting the first target segment by a lag corresponding to a maximum correlation coefficient of the array;

c4) repeating steps c2) and c3) until all targets of the excitation waveform have been correlated and aligned, resulting in an aligned excitation waveform; and c5) computing the representative portion by performing an ensemble process on the aligned excitation waveform.

4. The method as claimed in claim 3, further comprising the step of:

c6) normalizing the first target segment and the previous target segment to a uniform length prior to the correlating step.

5. The method as claimed in claim 3, wherein the step c5) comprises the step of:

c5a) performing the ensemble process wherein the ensemble process is an ensemble mean.

6. The method as claimed in claim 3, wherein the step c5) comprises the step of:

c5a) performing the ensemble process wherein the ensemble process is a synchronous matched filter average.

7. The method as claimed in claim 3, wherein the step c5) comprises the step of:

c5a) performing the ensemble process wherein the ensemble process is an ensemble filter.

8. The method as claimed in claim 1, wherein a first error waveform of the orthogonal error waveforms is an ensemble error waveform and step d) comprises the steps of:

d1) computing a periodic excitation model of the excitation waveform by ensemble interpolating between the target segment and the source segment;

d2) creating a reference excitation waveform; and d3) computing the ensemble error waveform by computing errors between the reference excitation waveform and the periodic excitation model.

9. The method as claimed in claim 8, wherein step d1) comprises the steps of:

d1a) energy normalizing the target segment and the source segment;

d1b) correlating the target segment with the source segment, resulting in an array of correlation coefficients;

d1c) aligning the target segment with the source segment by shifting the target segment by a lag corresponding to a maximum correlation coefficient of the array; and d1d) ensemble interpolating between an aligned version of the target segment and the source segment, resulting in a sequence of interpolated segments.

10. The method as claimed in claim 9, wherein step d2) comprises the steps of:

d2a) computing a mean of an epoch of the excitation waveform;

d2b) computing a standard deviation of the epoch of the excitation waveform;

d2c) energy normalizing the epoch by subtracting the mean and dividing by the standard deviation for the epoch; and d2d) repeating steps d2a) through d2c) until all epochs have been energy normalized.

11. The method as claimed in claim 10, further comprising the steps of:

d2e) aligning an energy normalized epoch with a second epoch of the sequence of interpolated segments; and d2f) repeating step d2e) until all energy normalized epochs have been aligned, producing the reference excitation waveform.

12. The method as claimed in claim 11, wherein step d2c) comprises the steps of:

d2e1) correlating the energy normalized epoch with the second epoch, producing a maximum correlation offset index; and d2e2) cyclically shifting the energy normalized epoch by the maximum correlation offset index, producing a shifted normalized epoch.

13. The method as claimed in claim 9, further comprising the step of:

d1e) pitch normalizing the target segment to a uniform normalizing length by upsampling the target segment when a target segment length is less than the uniform normalizing length and downsampling the target segment when the target segment length is more than the uniform normalizing length, wherein the correlating step is performed on the target segment after pitch normalizing.

14. The method as claimed in claim 9, wherein step d3) comprises the steps of:

d3a) computing a phase error between a reference segment of the reference excitation waveform relative to an interpolated segment, producing an integer offset value;

d3b) shifting the reference segment by the integer offset value, producing an aligned excitation reference;

d3c) subtracting the aligned excitation reference from the interpolated segment, producing a segment representing an ensemble error; and d3d) repeating steps d3a) through d3c) for each of interpolated segments and reference segments.

15. The method as claimed in claim 14, wherein step d3a) comprises the step of:

d3a1) correlating the reference segment with the interpolated segment.

16. The method as claimed in claim 1, wherein a second error waveform of the orthogonal error waveforms is a standard deviation error waveform, and step d) comprises the steps of:

d1) creating a standard deviation reference waveform from the excitation waveform;

d2) computing a standard deviation model from standard deviation values derived from the target segment and a source segment; and d3) computing the standard deviation error waveform by computing the error between the standard deviation reference waveform and the standard deviation model.

17. The method as claimed in claim 16, wherein step d2) comprises the steps of:

d2a) creating the standard deviation model by interpolating between a standard deviation of the source segment and the standard deviation of the target segment.

18. The method as claimed in claim 1, wherein a third error waveform of the orthogonal error waveforms is a mean error waveform, and step d) comprises the steps of:

d1) creating a mean reference waveform from the excitation waveform;

d2) computing a mean model from mean values derived from the target segment and the source segment; and d3) computing the mean error waveform by computing an error between the mean reference waveform and the mean model.

19. The method as claimed in claim 18, wherein step d2) comprises the steps of:

d2a) creating the mean model by interpolating between a mean of the source segment and a mean of the target segment.

20. The method as claimed in claim 1, wherein a fourth error waveform of the orthogonal error waveforms is a phase error waveform, and step d) comprises the steps of:

d1) computing a periodic excitation model of the excitation waveform by ensemble interpolating between the target segment and the source segment;

d2) creating a second excitation waveform by pitch normalizing the excitation waveform; and d3) phase normalizing the second excitation waveform, resulting in a reference excitation waveform and a phase error waveform.

21. The method as claimed in claim 20, wherein step d1) comprises the steps of:

d1a) energy normalizing the target segment and the source segment;

d1b) correlating the target segment with the source segment, resulting in an array of correlation coefficients;

d1c) aligning the target segment with the source segment by shifting the target segment by a lag corresponding to a maximum correlation coefficient of the array; and d1d) ensemble interpolating between an aligned version of the target segment and the source segment, resulting in a sequence of interpolated segments.

22. The method as claimed in claim 21, wherein step d3) comprises the steps of:

d3a) computing a mean of an epoch of the second excitation waveform;

d3b) computing a standard deviation of the epoch of the second excitation waveform;

d3c) energy normalizing the epoch by subtracting the mean and dividing by the standard deviation for the epoch; and d3d) repeating steps d3a) through d3c) until all epochs have been energy normalized.

23. The method as claimed in claim 22, further comprising the steps of:

d3e) aligning an energy normalized epoch with a second epoch of the sequence of interpolated segments; and d3f) repeating step d3e) until all energy normalized epochs have been aligned, producing the phase error waveform.

24. The method as claimed in claim 23, wherein step d3e) comprises the steps of:

d3e1) correlating the energy normalized epoch with the second epoch, producing a maximum correlation offset index; and d3e2) cyclically shifting the energy normalized epoch by the maximum correlation offset index, producing a shifted normalized epoch.

25. The method as claimed in claim 21, further comprising the step, performed before step d1b), of:

d1e) pitch normalizing the target segment and the source segment.

26. The method as claimed in claim 20, wherein step d2) comprises the step of:

d2a) pitch normalizing the target segment to a uniform normalizing length by upsampling the target segment when a target segment length is less than the uniform normalizing length and downsampling the target segment when the target segment length is more than the uniform normalizing length.

27. The method as claimed in claim 1, wherein the orthogonal error waveforms comprise an ensemble error waveform, a standard deviation error waveform, a mean error waveform, and a phase error waveform, and step d) comprises the steps of:

d1) computing a periodic excitation model of the excitation waveform by ensemble interpolating between the target segment which has been energy normalized and aligned and the source segment;

d2) creating a second excitation waveform by pitch normalizing and energy normalizing the excitation waveform;

d3) phase normalizing the second excitation waveform, resulting in a third excitation waveform, which will be used as a reference excitation waveform, and a phase error waveform;

d4) computing the ensemble error waveform by computing errors between the reference excitation waveform and the periodic excitation model;

d5) creating a standard deviation reference waveform from the excitation waveform;

d6) computing a standard deviation model from standard deviation values derived from the target segment and the source segment;

d7) computing the standard deviation error waveform by computing errors between the standard deviation reference waveform and the standard deviation model;

d8) creating a mean reference waveform from the excitation waveform;

d9) computing a mean model from mean values derived from the target segment and the source segment; and d10) computing the mean error waveform by computing errors between the mean reference waveform and the mean model.

28. The method as claimed in claim 1, wherein step e) comprises the step of:

e1) encoding the orthogonal error waveforms and the parameters using one or more trellis-coded quantizers.

29. The method as claimed in claim 1, wherein step e) comprises the step of:

e1) encoding the orthogonal error waveforms and parameters using one or more multi-stage vector quantizers, wherein a bitrate can be decreased by decreasing a number of stages employed by the one or more multi-stage vector quantizers, and the bitrate can be increased by increasing the number of stages employed by the one or more multi-stage vector quantizers.

30. The method as claimed in claim 1, wherein step e) comprises the step of:

e1) encoding a subset of the orthogonal error waveforms in order to decrease a bitrate to a desired bitrate, wherein a number of the orthogonal error waveforms in the subset depends on the desired bitrate.

31. The method as claimed in claim 30, wherein step e1) comprises the step of:

e1a) selecting particular error waveforms of the orthogonal error waveforms for the subset based on a hierarchy.

32. The method as claimed in claim 1, wherein step e) comprises the step of:

e1) encoding the orthogonal error waveforms and parameters using one or more vector quantizers, wherein a bitrate can be decreased by decreasing a size of a codebook used by the one or more vector quantizers, and the bitrate can be increased by increasing the size of the codebook used by the one or more vector quantizers.

33. The method as claimed in claim 1, wherein a first error waveform of the orthogonal error waveforms is an ensemble error waveform and step e) comprises the steps of:

a) characterizing the ensemble error waveform by filtering the ensemble error waveform, resulting in a filtered error waveform;

b) transforming the filtered error waveform into a frequency domain, resulting in an inphase waveform and a quadrature waveform;

c) selecting a codebook subset based on a degree-of-periodicity of the excitation waveform;

d) encoding a subset of samples of the inphase waveform using the codebook subset; and e) encoding a subset of samples of the quadrature waveform using the codebook subset.

34. The method as claimed in claim 33, further comprising the steps of:

f) determining whether a spectral model is to be used;

g) if the spectral model is to be used, performing a linear prediction coding (LPC) analysis on the filtered error waveform;

h) quantizing spectral parameters associated with the spectral model; and i) using a quantized version of the spectral parameters to inverse filter the filtered error waveform, resulting in a spectral error model excitation waveform which is used as the filtered error waveform in step b).

35. The method as claimed in claim 1, wherein a second error waveform of the orthogonal error waveforms is a standard deviation error waveform and step e) comprises the steps of:

e1) determining whether more than one segment exists in the excitation waveform;

e2) when more than one segment exists, upsampling the standard deviation error waveform to a common vector length;

e3) selecting a first codebook subset based on a degree-of-periodicity of the excitation waveform; and e4) encoding the standard deviation error waveform using the first codebook subset, resulting in a characterized, encoded standard deviation error waveform.

36. The method as claimed in claim 1, wherein a third error waveform of the orthogonal error waveforms is a mean error waveform and step e) comprises the steps of:

e1) determining whether more than one segment exists in the excitation waveform;

e2) when more than one segment exists, upsampling the mean error waveform to a common vector length;

e3) selecting a first codebook subset based on a degree-of-periodicity of the excitation waveform; and e4) encoding the mean error waveform using the first codebook subset, resulting in an characterized, encoded mean error waveform.

37. The method as claimed in claim 1, wherein a fourth error waveform of the orthogonal error waveforms is a phase error waveform and step e) comprises the steps of:

e1) determining whether more than one segment exists in the excitation waveform;

e2) when more than one segment exists, upsampling the phase error waveform to a common vector length;

e3) selecting a first codebook subset based on a degree-of-periodicity of the excitation waveform; and e4) encoding the phase error waveform using the first codebook subset, resulting in a characterized, encoded phase error waveform.

38. The method as claimed in claim 1, wherein step a) comprises the step of:

a1) epoch-aligning the number of samples of input speech which includes multiple epochs, resulting in epoch-aligned segment corresponding to one or more excitation epoch locations; and a2) performing the LPC analysis on the epoch-aligned segment.

39. The method as claimed in claim 38, wherein step a) further comprises the steps of:

a1) low-pass filtering a segment of speech samples, resulting in filtered speech samples;

a2) determining a waveform sense for each of the filtered speech samples, the speech samples, and a first excitation waveform;

a3) applying the waveform sense to each of the filtered speech samples, the speech samples, and the first excitation waveform;

a4) rectifying the filtered speech samples, the speech samples, and the first excitation waveform;

a5) setting deviation factors for each of the filtered speech samples, the speech samples, and the first excitation waveform;

a6) searching the filtered speech samples for first peaks at pitch intervals including a first deviation factor, resulting in filtered speech peak locations;

a7) searching the speech samples for second peaks including a second deviation factor, resulting in speech peak locations;

a8) searching the first excitation waveform for third peaks including a third deviation factor, resulting in excitation peak locations; and a9) assigning offsets to each of the excitation peak locations, resulting in the one or more excitation epoch locations.

40. The method as claimed in claim 1, wherein the step of computing orthogonal error waveforms comprises a step of estimating receiver epoch locations which comprises the steps of:

d1) loading a target index into a buffer;

d2) loading a source index into the buffer;

d3) estimating a pitch using the source index, the target index, and a number of epochs of the excitation waveform;

d4) setting an index pointer to the source index;

d5) incrementing the index pointer by the pitch, producing a subsequent index pointer;

d6) rounding the subsequent index pointer to a nearest integer;

d7) storing the subsequent index pointer; and d8) repeating steps d5) through d7) until all the receiver epoch locations have been estimated.

41. The method as claimed in claim 1, wherein step e) comprises a step of encoding the target segment which comprises the steps of:

e1) downsampling the target segment when a size of the target segment exceeds a first number of samples;

e2) energy normalizing the target segment;

e3) performing a cyclic transform on the energy normalized target segment, resulting in a cyclically transformed segment;

e4) performing a time-domain to frequency-domain transformation of the cyclically transformed segment, resulting in a frequency-domain representation;

e5) selecting a codebook subset corresponding to a degree of periodicity of the excitation waveform;

e6) encoding a subset of an inphase component of the frequency-domain representation; and e7) encoding a subset of a quadrature component of the frequency-domain representation.

42. The method as claimed in claim 1, further comprising the step, performed before step d) of:

g) encoding a first set of parameters describing the input speech, wherein step d) computes the orthogonal error waveforms using the encoded first set of parameters.

43. The method as claimed in claim 42, wherein step g) comprises a step of encoding the target segment which comprises the steps of:

g1) downsampling the target segment when a size of the target segment exceeds a first number of samples;

g2) energy normalizing the target segment;

g3) performing a cyclic transform on the energy normalized target segment, resulting in a cyclically transformed segment;

g4) performing a time-domain to frequency-domain transformation of the cyclically transformed segment, resulting in a frequency-domain representation;

g5) selecting a codebook subset corresponding to a degree of periodicity of the excitation waveform;

g6) encoding a subset of an inphase component of the frequency-domain representation;

g7) encoding a subset of a quadrature component of the frequency-domain representation;

g8) computing a conjugate spectrum from the encoded inphase component and the encoded quadrature component, resulting in reconstructed inphase and quadrature vectors;

g9) performing a frequency-domain to time-domain transformation on the reconstructed inphase and quadrature vectors, resulting in a cyclically shifted, energy normalized, quantized target;

g10) performing an inverse cyclic transform on the a cyclically shifted, energy normalized, quantized target, resulting in a quantized target; and g11) upsampling the quantized target to an original target length when step g1) was previously performed.

44. The method as claimed in claim 1, wherein the parameters comprise a degree of periodicity, the method further comprising the step of calculating the degree of periodicity which comprises the steps of:

g) computing at least one feature which conveys the degree of periodicity of the samples of input speech;

h) loading multi-layer perceptron (MLP) weights into memory;

i) computing an MLP output of a MLP classifier using the MLP weights and the at least one feature; and j) computing the degree of periodicity by scalar quantizing the MLP output.

45. The method as claimed in claim 44, wherein the at least one feature comprises a subframe autocorrelation coefficient, a subframe LPC gain, a subframe energy ratio, and a subframe energy ratio to prior subframe energies.

46. The method as claimed in claim 1, wherein the parameters comprise a pitch, the method further comprising the step of calculating the pitch which comprises the steps of:

g) bandpass filtering the samples of input speech;

h) computing multiple subframe autocorrelations of the filtered samples of input speech;

i) selecting maximum correlation subset from the multiple subframe autocorrelations;

j) selecting an initial pitch estimate from the maximum correlation subset;

k) searching for harmonic locations corresponding to the initial pitch estimate in the maximum correlation subset; and l) selecting a minimum harmonic location of the harmonic locations, the minimum harmonic location corresponding to the pitch.

47. A method for encoding speech comprising the steps of:

a) computing at least one orthogonal model by extracting at least one excitation parameter from an excitation waveform, normalizing the excitation waveform by the at least one excitation parameter, and interpolating between elided parameters;

b) computing at least one error waveform corresponding to each of the at least one orthogonal model and the elided parameters;

c) encoding the at least one orthogonal model and the at least one error waveform; and d) creating a bitstream which includes encoded versions of the at least one orthogonal model and the at least one error waveform.

48. A method for encoding speech comprising the steps of:

a) obtaining a number of samples of input speech;

b) selecting a source segment of the input speech;

c) computing a target segment as a portion of the input speech, wherein the target segment represents a fundamental period of the input speech;

d) computing orthogonal error waveforms by computing at least one model, at least one model reference, and comparing the at least one model reference and the at least one model;

e) encoding the orthogonal error waveforms and parameters describing the input speech; and f) creating a bitstream which includes encoded versions of the orthogonal error waveforms and the parameters.

49. A method for decoding a characterized, encoded standard deviation error waveform comprising the steps of:

a) receiving an index representative of the characterized, encoded standard deviation error waveform;

b) selecting a second codebook subset which corresponds to a first codebook subset which was used to encode a standard deviation error based on a degree-of-periodicity of an excitation waveform;

c) decoding the characterized, encoded standard deviation error waveform using the second codebook subset, resulting in a characterized standard deviation error;

d) determining whether more than one epoch exists; and e) if more than one epoch exists, downsampling the characterized standard deviation error to a number of samples equal to a number of epochs.

50. A method for decoding a characterized, encoded mean error waveform comprising the steps of:

a) receiving an index representative of the characterized, encoded mean error waveform;

b) selecting a second codebook subset which corresponds to a first codebook subset which was used to encode a mean error based on a degree-of-periodicity of an excitation waveform;

c) decoding the characterized, encoded mean error waveform using the second codebook subset, resulting in a characterized mean error waveform;

d) determining whether more than one epoch exists; and e) if more than one epoch exists, downsampling the characterized mean error waveform to a number of samples equal to a number of epochs.

51. A method for decoding a characterized, encoded phase error waveform comprising the steps of:

a) receiving the characterized, encoded phase error waveform;

b) selecting a second codebook subset which corresponds to a first codebook subset which was used to encode a phase error based on a degree-of-periodicity of an excitation waveform;

c) decoding the characterized, encoded phase error waveform using the second codebook subset, resulting in a characterized phase error;

d) determining whether more than one epoch exists; and e) if more than one epoch exists, downsampling the characterized phase error to a number of samples equal to a number of epochs.

52. A method for synthesizing a speech waveform from information contained within a bitstream, the method comprising the steps of:

a) receiving the bitstream having a degree-of-periodicity indicator, an encoded inphase error vector, and an encoded quadrature error vector;

b) selecting a codebook subset based on the degree-of-periodicity indicator;

c) decoding the encoded inphase error vector and the encoded quadrature error vector using the codebook subset, resulting in a decoded inphase error vector and a decoded quadrature error vector;

d) cyclically repeating the decoded inphase error vector and the decoded quadrature error vector, resulting in a repeating inphase error vector and a repeating quadrature error vector;

e) computing a conjugate spectrum of the repeating quadrature error vector and the repeating inphase error vector; and f) performing a frequency-domain to time-domain transformation of the conjugate spectrum, resulting in an ensemble error waveform.

53. The method as claimed in claim 52, wherein step d) comprises the step of:

d1) cyclically repeating the decoded inphase error vector and the decoded quadrature error vector, including changing a sign of a repeated vector for each successive cycle.

54. The method as claimed in claim 52, further comprising the step of:

g) applying a weighting function to the repeating inphase error vector and the repeating quadrature error vector.

55. The method as claimed in claim 52, further comprising the step of:

g) adding scaled noise to the repeating inphase error vector and the repeating quadrature error vector.

56. A method for synthesizing speech comprising the steps of:

a) decoding orthogonal error waveforms and parameters describing encoded speech;

b) computing an excitation estimate from the decoded orthogonal error waveforms and the decoded parameters; and c) synthesizing speech from the excitation estimate and the decoded parameters.

57. The method as claimed in claim 56, wherein step a) comprises the step of decoding a target segment which comprises the steps of:

a1) selecting a codebook subset corresponding to a degree of periodicity of the encoded speech;

a2) decoding an inphase component of a frequency-domain representation of an encoded inphase component;

a3) decoding a quadrature component of a frequency-domain representation of an encoded quadrature component;

a4) computing a conjugate spectrum from the decoded inphase component and the decoded quadrature component, resulting in reconstructed inphase and quadrature vectors;

a5) performing a frequency-domain to time-domain transformation on the reconstructed inphase and quadrature vectors, resulting in a cyclically shifted, energy normalized, quantized target;

a6) performing an inverse cyclic transform on the a cyclically shift, energy normalized, quantized target, resulting in a quantized target; and a7) upsampling the quantized target to an original target length when the quantized target was downsampled during encoding.

58. The method as claimed in claim 56, wherein step a) comprises a step of decoding an ensemble error which comprises the steps of:

a1) selecting a codebook subset corresponding to a degree of periodicity of the encoded speech;

a2) decoding an inphase component of a frequency-domain representation of an encoded inphase component;

a3) decoding a quadrature component of a frequency-domain representation of an encoded quadrature component;

a4) performing modulo-F cyclic repetition on the decoded inphase component and the decoded quadrature component, resulting in a second inphase component and a second quadrature component;

a5) computing a conjugate spectrum from the second inphase component and the second quadrature component, resulting in reconstructed inphase and quadrature vectors; and a6) performing a frequency-domain to time-domain transformation on the reconstructed inphase and quadrature vectors, resulting in the ensemble error.

59. The method as claimed in claim 58, wherein step a4) comprises the steps of:

a4a) cyclically repeating the inphase component at a modulo-F interval, wherein F represents a characterization filter cutoff, resulting in contiguous successive inphase cycles;

a4b) alternately changing signs of the contiguous successive inphase cycles;

a4c) weighting the contiguous successive inphase cycles;

a4d) cyclically repeating the quadrature component at the modulo-F interval, wherein F represents the characterization filter cutoff, resulting in contiguous successive quadrature cycles;

a4e) alternately changing signs of the contiguous successive quadrature cycles; and a4f) weighting the contiguous successive quadrature cycles.

60. The method as claimed in claim 59, further comprising the step of:

a4g) applying noise to the contiguous successive inphase cycles and the contiguous successive quadrature cycles.

61. The method as claimed in claim 56, wherein step a) comprises a step of decoding an ensemble error which comprises the steps of:

a1) selecting a codebook subset corresponding to a degree of periodicity of the encoded speech;

a2) decoding an inphase component of a frequency-domain representation of an encoded inphase component;

a3) decoding a quadrature component of a frequency-domain representation of an encoded quadrature component;

a4) computing a conjugate spectrum from the decoded inphase component and the decoded quadrature component, resulting in reconstructed inphase and quadrature vectors;

a5) performing a frequency-domain to time-domain transformation on the reconstructed inphase and quadrature vectors, resulting in a spectral error model excitation waveform;

a6) decoding spectral error model parameters;

a7) performing a prediction filter which uses the spectral error model parameters and the spectral error model excitation waveform, resulting in the ensemble error;

a8) performing a time-domain to frequency-domain transformation on the ensemble error, resulting in a second inphase component and a second quadrature component;

a9) performing modulo-F cyclic repetition on the second inphase component and the second quadrature component, resulting in a third inphase component and a third quadrature component;

a10) computing a second conjugate spectrum from the third inphase component and the third quadrature component; and a11) performing a frequency-domain to time-domain transformation on the third inphase component and the third quadrature component, resulting in the ensemble error.

62. The method as claimed in claim 56, wherein step b) comprises the steps of:

b1) pitch normalizing a decoded target segment, resulting in a pitch normalized target;

b2) correlating a source segment with the pitch normalized target, resulting in a cyclically shifted target;

b3) ensemble interpolating between the source segment and the cyclically shifted target, resulting in intervening epochs corresponding to a number of epochs in an analysis segment minus one, resulting in an ensemble interpolated waveform;

b4) phase shifting an ensemble error waveform so that the ensemble error waveform is aligned with the ensemble interpolated waveform;

b5) applying the phase shifted ensemble error waveform to the ensemble interpolated waveform, resulting in a pitch normalized, energy normalized, shifted excitation waveform;

b6) interpolating a standard deviation, resulting in a standard deviation model;

b7) applying a standard deviation error to the standard deviation model, resulting in a second standard deviation model;

b8) interpolating a mean, resulting in a mean model;

b9) applying a mean error to the mean model, resulting in a second mean model;

b10) phase shifting each epoch of the pitch normalized, energy normalized, shifted excitation waveform, resulting in a pitch normalized, energy normalized excitation waveform;

b11) denormalizing a pitch of the pitch normalized, energy normalized excitation waveform, resulting in an energy normalized excitation waveform; and b12) energy denormalizing the energy normalized excitation waveform using the second standard deviation model and the second mean model, resulting in an excitation waveform.

63. A method for synthesizing speech comprising the steps of:

a) decoding orthogonal error waveforms and parameters describing encoded speech; and b) computing a speech estimate from the decoded orthogonal error waveforms and the decoded parameters, resulting in synthesized speech.

64. A speech encoding apparatus comprising:

means for generating an excitation waveform by performing a linear prediction coding (LPC) analysis on a number of samples of input speech and inverse filtering the samples of input speech;

means for selecting a source segment of the excitation waveform, coupled to the means for generating the excitation waveform;

means for computing a target segment as a representative portion of the excitation waveform, coupled to the means for selecting the source, wherein the target segment represents a fundamental period of the excitation waveform;

means for computing orthogonal error waveforms, coupled to the means for computing the target, by computing at least one model, at least one model reference, and comparing the at least one model reference and the at least one model;

means for encoding the orthogonal error waveforms and parameters describing the input speech, coupled to the means for computing the orthogonal error waveforms; and means for creating a bitstream which includes encoded versions of the orthogonal error waveforms and the parameters, coupled to the means for encoding.

* * * * *